US010876293B2

(12) United States Patent
Webb et al.

(10) Patent No.: US 10,876,293 B2
(45) Date of Patent: Dec. 29, 2020

(54) COMPOSITE STRUCTURAL MEMBER FOR A BUILDING STRUCTURE

(71) Applicant: AUVENA PTY LTD ATF UNIT TRUST ACN 613 738 551, Indooroopilly (AU)

(72) Inventors: Ronald Joseph Webb, Carina Heights (AU); Hamish John Webb, Carina Heights (AU)

(73) Assignee: AUVENA PTY LTD ATF AUVENCO UNIT TRUST ACN 613 738 551, Indooroopilly (AU)

( * ) Notice: Subject to any disclaimer, the term of this patent is extended or adjusted under 35 U.S.C. 154(b) by 0 days.

(21) Appl. No.: 16/721,148

(22) Filed: Dec. 19, 2019

(65) Prior Publication Data

US 2020/0123773 A1 Apr. 23, 2020

Related U.S. Application Data

(62) Division of application No. 15/253,072, filed on Aug. 31, 2016, now Pat. No. 10,550,572.

(30) Foreign Application Priority Data

Jan. 8, 2016 (AU) ..... 2016200130

(51) Int. Cl.
*E04C 3/00* (2006.01)
*E04C 3/04* (2006.01)
(Continued)

(52) U.S. Cl.
CPC ..... *E04C 3/04* (2013.01); *E04B 1/24* (2013.01); *E04C 3/06* (2013.01); *E04C 3/14* (2013.01); *E04C 3/20* (2013.01); *E04C 3/32* (2013.01); *E04C 3/40* (2013.01); *E04B 7/024* (2013.01); *E04B 2001/2415* (2013.01); *E04B 2001/2469* (2013.01); *E04B 2001/2472* (2013.01);
(Continued)

(58) Field of Classification Search
None
See application file for complete search history.

(56) References Cited

U.S. PATENT DOCUMENTS 3,461,636 A * 8/1969 Hern ..... E04B 1/24 52/650.1
3,971,179 A * 7/1976 Bodocsi ..... E04B 1/24 52/223.11
(Continued)

*Primary Examiner* — Basil S Katcheves
(74) *Attorney, Agent, or Firm* — Richard P. Gilly, Esquire; Gregory J. Winsky; Archer & Greiner, P.C.

(57) ABSTRACT

A composite structural member for a building structure comprises a first elongate portion having a first end region and a second end region and a second elongate portion having a first end region and a second end region. The second end region of the first elongate portion is connected to the first end region of the second elongate portion so that the composite structural member provided thereby is substantially longer than either of the first and second elongate portions. The first elongate portion may comprise a first member suited for resisting high magnitude forces and the second elongate portion may be a second member, less well suited for resisting high forces but having lower cost per unit length. The composite structural member may be a rafter, especially a rafter of a portal frame.

20 Claims, 17 Drawing Sheets

(51) Int. Cl.

| | |
|---|---|
| ***E04B 1/24*** | (2006.01) |
| ***E04C 3/20*** | (2006.01) |
| ***E04C 3/06*** | (2006.01) |
| ***E04C 3/32*** | (2006.01) |
| ***E04C 3/14*** | (2006.01) |
| ***E04C 3/40*** | (2006.01) |
| *E04B 7/02* | (2006.01) |

(52) U.S. Cl.
CPC ..... *E04B 2001/2487* (2013.01); *E04B 2001/2493* (2013.01); *E04C 2003/0413* (2013.01); *E04C 2003/0434* (2013.01); *E04C 2003/0452* (2013.01); *E04C 2003/0473* (2013.01)

(56) References Cited

U.S. PATENT DOCUMENTS 4,409,765 A * 10/1983 Pall ..... E04B 1/2403 52/167.1
5,375,382 A * 12/1994 Weidlinger ..... E04B 1/98 52/167.3
5,660,017 A * 8/1997 Houghton ..... E04B 1/2403 52/167.3
5,692,353 A * 12/1997 Bass ..... E04G 23/0218 52/653.1
5,735,100 A * 4/1998 Campbell ..... E04B 5/10 52/645
5,983,577 A * 11/1999 Hays ..... E04B 1/24 52/640
6,412,237 B1 * 7/2002 Sahai ..... E04H 9/02 52/167.1
6,672,573 B2 * 1/2004 Berton ..... E04H 9/02 267/136
7,383,665 B2 * 6/2008 Frobosilo ..... E04B 2/58 52/204.2
7,941,985 B2 * 5/2011 Simmons ..... E04B 1/24 52/655.1
9,091,065 B2 * 7/2015 Tran ..... E04B 1/40
10,006,219 B1 * 6/2018 Mehrain ..... E04G 23/0218
10,017,935 B2 * 7/2018 Corden ..... E04B 1/5818
2004/0200172 A1 * 10/2004 Beck ..... E04B 1/24 52/506.03
2005/0022465 A1 * 2/2005 Warren ..... E04C 3/28 52/653.2
2005/0204684 A1 * 9/2005 Houghton ..... E04B 1/24 52/653.1
2007/0102480 A1 * 5/2007 Lip ..... B23K 9/0052 228/101
2008/0148681 A1 * 6/2008 Hiriyur ..... E04H 9/0237 52/690
2008/0229683 A1 * 9/2008 Bystricky ..... E04H 9/0237 52/167.3
2008/0245017 A1 * 10/2008 Hawes ..... E04G 21/24 52/506.02
2008/0289267 A1 * 11/2008 Sarkisian ..... E04B 1/2403 52/167.3
2010/0132286 A1 * 6/2010 Hovey, Jr. ..... E04B 1/24 52/299
2013/0283721 A1 * 10/2013 Ahn ..... E04B 5/43 52/649.6
2014/0099456 A1 * 4/2014 Raghavendran ..... B32B 13/02 428/34.4
2014/0134394 A1 * 5/2014 Noble ..... E04C 3/28 428/138
2015/0096244 A1 * 4/2015 Richards ..... E04B 1/98 52/167.1
2015/0159362 A1 * 6/2015 Pryor ..... E04B 1/1903 52/98
2016/0032581 A1 * 2/2016 Sklar ..... E04B 1/1903 52/220.8
2016/0215492 A1 * 7/2016 Karns ..... E04C 3/04

* cited by examiner

BENDING MOMENT IN RAFTERS

COMPOSITE STRUCTURAL MEMBER FOR A BUILDING STRUCTURE

FIELD

The present disclosure relates to a composite structural member for a building structure and especially, but not exclusively, to a composite structural member for use as a rafter in a building. The disclosure further relates to a method of designing a structural member, to a frame structure, for use in a building, including a composite structural member, to a building, and to a method of providing a building structure.

DEFINITIONS

In this specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

In this specification the term "building", when used as a noun, shall be understood to mean a relatively permanent structure built as a dwelling, shelter, or place for human activities and including a roof, but shall not be limited to a structure which includes walls. For example, Dutch barns and like structures, which may be used to shelter products or animals, should be considered to fall within the meaning of "building" as used herein, irrespective of whether such structures include walls.

In this specification the word "composite", when used in the terms "composite structural member", "composite member" or "composite rafter" shall be understood to mean that the member or rafter comprises two or more separately manufactured parts which are connected to form the member or rafter. It should be understood such use of the word "composite" is not intended to mean that the member or rafter is formed from a composite material of the type that comprises a plurality of layers or sheets of material bonded together, or fibres (or other reinforcing material) bound within a binder or matrix.

BACKGROUND

Certain structural members in buildings are subject to, and required to resist, various forces.

For example, in portal frames, which are commonly used in building construction, an inclined rafter may extend between a substantially vertical column and an apex of the portal frame and may in use be required to resist forces resulting from, for example, the weight of parts of the building, wind loads, additional forces such as those resulting from a person walking on the roof of the building, and other forces.

In a known portal frame, the material and dimensions of the rafters are selected to allow the rafters, each of which is of substantially uniform in transverse cross sectional shape and size along its length, to adequately resist the forces to which they are expected to be subject and which they are required to resist in use.

SUMMARY

The present inventors have discerned that forces which a structural member is required to resist may vary along the length of the structural member.

For example, a rafter of a portal frame may be required to resist substantial moment forces at a lower region thereof adjacent its connection to a column of the portal frame. By comparison, at a higher region of the rafter, for example close to the apex of the portal frame, the moment forces which the rafter is typically required to resist may be substantially smaller in magnitude.

Further, the present inventors have discerned that the common approach to building design, which is to specify a structural member which is substantially uniform along its length and with characteristics appropriate for resisting the forces which it is required to resist at any point along its length, may result in an inefficient design, because the structural member will have, at various points along its length, a capacity to resist forces far in excess of the required capacity at that point.

According to an aspect of the present disclosure there is provided a composite structural member for a building structure comprising a first longitudinal part comprising a first elongate structural component with characteristics appropriate for resisting forces to which the first longitudinal part is expected to be subject, connected substantially end-to-end with a second longitudinal part comprising a second elongate structural component, which is a different type of structural component to the first structural component, and which has characteristics appropriate for resisting forces to which the second longitudinal part is expected to be subjected.

In an embodiment the first and second elongate structural components are different types of structural component by virtue of being made of different types of material.

In an embodiment the different types of material are different types of steel.

In an embodiment the different types of material are different grades of steel.

In an embodiment the first and second elongate structural components are different types of structural component by virtue of being made by different manufacturing methods.

In an embodiment one and only one of the first and second elongate structural components comprises a hot rolled steel member.

In an embodiment one and only one of the first and second elongate structural components comprises a cold formed steel member.

For the purposes of this specification hot rolled steel members and cold formed steel members should be regarded as comprising different materials, since even if formed from the same nominal grade of steel there will be differences attributable to the material itself (for example different grain structure) which affect performance.

In an embodiment one of the first and second elongate structural components comprises a hot rolled steel member and the other of the first and second elongate structural components comprises a cold formed steel member.

In an embodiment the first elongate structural component comprises a hot rolled steel member.

In an embodiment the second elongate structural component comprises a cold formed steel member.

In an embodiment the first and second elongate structural components are different types of structural component by virtue of being of different construction.

Selection of appropriate first and second elongate structural components can allow the composite structural member to be more efficient and cost-effective than a single piece structural member which is uniform along its length.

An embodiment is in the form of a composite structural member which is required to resist greater forces at the first longitudinal part thereof, and to resist smaller forces at the second longitudinal part thereof.

An embodiment is in the form of a composite structural member which is required to resist greater moment forces at the first longitudinal part thereof, and to resist smaller moment forces at the second longitudinal part thereof.

The first longitudinal part may correspond to an in use lower region of the composite structural member, and the second longitudinal part may correspond to an in use higher region of the composite structural member.

The first elongate structural component may be a member well suited to resisting said greater forces, and the second elongate structural component may be a member well suited to resisting said smaller forces.

The second elongate structural component may be unsuitable for resisting said greater forces. The second elongate structural component may be of lower cost per unit length than the first elongate structural component.

The composite structural member may therefore be of lower average cost per unit length than a structural member which is substantially uniform along its length and which is of the same type as the first elongate structural component (or which is otherwise suitable for resisting said greater moment forces).

In an embodiment the composite structural member is a rafter for a portal frame

An embodiment is in the form of a composite rafter for a portal frame which is required to resist greater moment forces at the first longitudinal part corresponding to an in use lower region thereof, and to resist smaller moment forces at the second longitudinal part corresponding to an in use higher region thereof.

According to another aspect of the present disclosure there is provided a composite structural member for a building structure comprising:

a first elongate structural portion having a first end region and a second end region; and a second elongate structural portion having a first end region and a second end region;

wherein the second end region of the first elongate structural portion is connected to the first end region of the second elongate structural portion so that the composite structural member provided thereby is longer than either of the first and second elongate structural portions.

In an embodiment the first elongate structural portion comprises a first elongate structural component.

In an embodiment the second elongate structural portion comprises a second elongate structural component.

In an embodiment the first elongate structural component comprises a first component member of the composite structural member.

In an embodiment the second elongate structural component comprises a second component member of the composite structural member.

In an embodiment the first elongate portion is better adapted than the second elongate structural portion to resist an applied force of given high magnitude.

In an embodiment the first elongate portion is better adapted than the second elongate structural portion to resist a high magnitude bending moment.

In an embodiment the second elongate portion is of lower cost per unit length than the first elongate structural portion.

In an embodiment the first elongate portion is made of a first material and the second elongate portion is made of a second material which is different to the first material.

In an embodiment the different materials are different types of steel.

In an embodiment the different materials are different grades of steel.

In an embodiment the first and second elongate structural components are made by different manufacturing methods.

In an embodiment one and only one of the first and second elongate structural components comprises a hot rolled steel member.

In an embodiment one and only one of the first and second elongate structural components comprises a cold formed steel member.

In an embodiment one of the first and second elongate structural components comprises a hot rolled steel member and the other of the first and second elongate structural components comprises a cold formed steel member.

In an embodiment the first elongate structural component comprises a hot rolled steel member.

In an embodiment the second elongate structural component comprises a cold formed steel member.

In an embodiment the first material comprises hot formed or a mild/soft grade of steel.

In an embodiment the first material comprises steel of a grade between about G250 up to about G300.

In an embodiment the first material comprises concrete.

In embodiment the second material comprises cold formed steel.

In an embodiment the second material comprises steel of a grade with a high tensile strength of about G350 to G550.

In an embodiment the second material comprises steel of a grade with a high tensile strength of about G400 to G550.

In embodiment the second material comprises timber.

In embodiment the second material comprises a carbon fibre composite material.

In an embodiment the first elongate portion has a first structure and the second elongate element has a second structure which is different to the first structure.

In an embodiment the first structure is better adapted than the second structure resist an applied force of given high magnitude.

In an embodiment the first structure is better adapted than the second structure to resist a high magnitude bending moment In an embodiment the second structure is of lower cost per unit length than the first structure.

In an embodiment the first structure comprises a metal section.

In an embodiment the first structure comprises a generally I-shaped or H-shaped cross section.

In an embodiment the first structure comprises a metal beam of generally I-shaped or H-shaped cross section.

In an embodiment the first structure comprises an open lattice.

In an embodiment the first structure comprises an open web formed of metal members.

In an embodiment the first structure comprises an open web formed of one or more of: SHS members; RHS members; angle members; channel members.

In an embodiment the second structure comprises a metal section.

In an embodiment the second structure comprises a metal channel section.

In an embodiment the second structure comprises a metal section which has a generally I-shaped or H-shaped cross section.

In an embodiment the second structure comprises a metal section which has a generally circular or annular cross section.

In an embodiment the second structure comprises two or more metal sections connected along their lengths.

In an embodiment the second structure comprises two or more metal sections securely connected along their lengths to form a beam having a web extending between two flange portions.

In an embodiment the second structure comprises two or more metal C-sections connected along their lengths.

In an embodiment the composite structural member is a rafter.

In an embodiment the composite structural member is a rafter for a portal frame of a building.

In an embodiment at least one of the first material and the first structure is better adapted than a respective one of the second material and the second structure to resist an applied force of given high magnitude.

In an embodiment at least one of the first material and the first structure is better adapted than a respective one of the second material and the second structure to resist a high magnitude bending moment.

In an embodiment the first elongate portion has a greater mean mass per unit length than the second elongate portion.

In an embodiment the first elongate portion has a mean mass per unit length which is at least twice the mean mass per unit length of the second elongate portion.

In an embodiment the first elongate portion has a mean mass per unit length which is at least three times the mean mass per unit length of the second elongate portion.

In an embodiment the first elongate portion has a mean mass per unit length which is at least four times the mean mass per unit length of the second elongate portion.

In an embodiment the first and second elongate portions are separately manufactured.

In an embodiment the first and second elongate portions are manufactured by different manufacturing processes.

In an embodiment the first elongate portion is manufactured by a process comprising one or more of: hot rolled metal, casting metal, extruding metal, concrete casting, constructing an open lattice or web of metal members.

In an embodiment the second elongate portion is manufactured by a process comprising one or more of: cold forming metal, welding together metal sections to form an elongate beam; manufacturing a timber beam; manufacturing a fibre-polymer composite beam; manufacturing a carbon fibre composite beam.

In an embodiment the composite structural member has a length of at least 12 metres.

In an embodiment the composite structural member has a length of at least 15 metres.

In an embodiment the length of the first elongate portion is greater than 5% of the length of the composite structural member.

In an embodiment the length of the first elongate portion is less than 65% of the length of the composite structural member.

In an embodiment the length of the first elongate portion is between 5% and 65% of the length of the composite structural member.

In an embodiment the length of the second elongate portion is greater than 35% of the length of the composite structural member.

In an embodiment the length of the second elongate portion is less than 95% of the length of the composite structural member.

In an embodiment the length of the second elongate portion is between 35% and 95% of the length of the composite structural member.

In an embodiment the length of the first elongate portion is greater than 15% of the length of the composite structural member.

In an embodiment the length of the first elongate portion is less than 51% of the length of the composite structural member.

In an embodiment the length of the first elongate portion is between 15% and 51% of the length of the composite structural member.

In an embodiment the length of the second elongate portion is greater than 49% of the length of the composite structural member.

In an embodiment the length of the second elongate portion is less than 85% of the length of the composite structural member.

In an embodiment the length of the second elongate portion is between 49% and 85% of the length of the composite structural member.

In an embodiment the length of the first elongate portion is greater than 20% of the length of the composite structural member.

In an embodiment the length of the first elongate portion is less than 40% of the length of the composite structural member.

In an embodiment the length of the first elongate portion is between 20% and 40% of the length of the composite structural member.

In an embodiment the length of the second elongate portion is greater than 60% of the length of the composite structural member.

In an embodiment the length of the second elongate portion is less than 80% of the length of the composite structural member.

In an embodiment the length of the second elongate portion is between 60% and 80% of the length of the composite structural member.

In an embodiment the length of the first elongate portion is greater than 22% of the length of the composite structural member.

In an embodiment the length of the first elongate portion is less than 30% of the length of the composite structural member.

In an embodiment the length of the first elongate portion is between 22% and 30% of the length of the composite structural member.

In an embodiment the length of the second elongate portion is greater than 70% of the length of the composite structural member.

In an embodiment the length of the second elongate portion is less than 78% of the length of the composite structural member.

In an embodiment the length of the second elongate portion is between 70% and 78% of the length of the composite structural member.

In an embodiment the composite structural member is at least 20% longer than either of the first and second elongate structural components.

In an embodiment the first end region of the first elongate structural component is distal from the second elongate structural component, and the second end region of the second elongate structural component is distal from the first elongate structural component.

In an embodiment the first and second elongate structural components are connected substantially end-to-end.

In an embodiment the second end region of the first elongate portion and the first end region of the second elongate portion are secured together by one or more of: welding, fasteners secured through aligned apertures.

In an embodiment the composite structural member comprises at least one connection member which is secured to the second end region of the first elongate portion and the first end region of the second elongate portion.

In an embodiment at least one said connection member is secured to an in use upper flange of at least one of the first elongate portion and the second elongate portion.

In an embodiment at least one said connection member is secured to an in use lower flange of at least one of the first elongate portion and the second elongate portion.

In an embodiment at least one said connection member is secured to a web portion of at least one of the first elongate portion and the second elongate portion.

In an embodiment the second end region of the first elongate portion provides a support portion for supporting the first end region of the second elongate portion before the second end region of the first elongate portion and the first end region of the second elongate portion are secured together. In an embodiment said support portion comprises a flange or shelf extending transversely with respect to the first elongate portion.

According to a further aspect of the present disclosure there is provided a frame for a building comprising:

first and second substantially vertical support portions, which are spaced apart from each other;

a first elongate structural member connected to an upper region of the first substantially vertical support portion and extending away therefrom;

a second elongate structural member connected to an upper region of the second substantially vertical support portion and extending away therefrom;

wherein the first and second elongate structural members are coupled together at an apex region of the frame; and wherein the first elongate structural member is a composite structural member in accordance with at least one of the preceding aspects.

In an embodiment the first elongate portion of the first elongate structural member is formed from substantially the same material as at least the upper region of the first substantially vertical support portion.

In an embodiment the first elongate portion of the first elongate structural member is formed integrally with at least the upper region of the first substantially vertical support portion.

According to a still further aspect of the present disclosure there is provided a method of designing a composite structural element for a building structure, comprising:

assessing requirements for a structural member to be provided, including assessing a required resistance to a type of applied force which the structural member is required to be capable of resisting at various points or regions along the length of the structural member to be provided;

determining at least one first portion along the length of the structural member to be provided where the required resistance to said at least one type of applied force is maximum;

identifying characteristics defining a first type of structural member capable of providing the maximum required resistance, and selecting said first type of structural member to use for a second structural member to provide the first portion of the structural member;

determining at least one second portion along the length of the structural member to be provided, where the required resistance to said at least one type of applied force is substantially smaller than said maximum required resistance;

identifying characteristics defining a second type of structural member capable of providing said smaller resistance but incapable of providing said maximum required resistance, and selecting said second type of structural member to use for a second structural member to provide the second portion of the structural member to be provided; and determining a position, along the length of the structural member to be provided, at which to provide a transition between the first structural member and the second structural member.

In an embodiment the position determined for the transition is a position at which the required resistance to said at least one type of applied force is at least seventy percent of the safe capacity of the second structural member to resist that force.

In an embodiment the position determined for the transition is a position at which the required resistance to said at least one type of applied force is at least eighty percent of the safe capacity of the second structural member to resist that force.

In an embodiment the position determined for the transition is a position at which the required resistance to said at least one type of applied force is at least ninety percent of the safe capacity of the second structural member to resist that force.

In an embodiment the position determined for the transition is a position at which the required resistance to said at least one type of applied force is at least ninety five percent of the safe capacity of the second structural member to resist that force.

In an embodiment the position determined for the transition is a position at which the required resistance to said at least one type of applied force is substantially equal to the safe capacity of the second structural member to resist that force.

As used above, the 'safe capacity' refers to the capacity of the second structural member to resist a force allowing a margin of error, for safety, appropriate to the design criteria for the structural element being designed.

In an embodiment the position determined for the transition is a position at which the length of the first structural member is substantially the minimum length that allows said second type of structural member to be used at the transition without the required resistance at the transition exceeding the safe capacity of the second type of structural member.

In an embodiment the position determined for the transition is a position at which the length of the first structural member is no more than ten percent greater than the minimum length that allows said second type of structural member to be used at the transition without the required resistance at the transition exceeding the safe capacity of the second type of structural member.

In an embodiment the position determined for the transition is a position at which the length of the first structural member is no more than twenty percent greater than the minimum length that allows said second type of structural member to be used at the transition without the required resistance at the transition exceeding the safe capacity of the second type of structural member.

In an embodiment the position determined for the transition is a position at which the length of the first structural member is no more than thirty percent greater than the minimum length that allows said second type of structural member to be used at the transition without the required resistance at the transition exceeding the safe capacity of the second type of structural member.

In an embodiment the position determined for the transition is a position at which the length of the first structural member is no more than sixty percent greater than the minimum length that allows said second type of structural member to be used at the transition without the required resistance at the transition exceeding the safe capacity of the second type of structural member.

In an embodiment the position determined for the transition is a position at which the length of the first structural member is no more than 100% greater than the minimum length that allows said second type of structural member to be used at the transition without the required resistance at the transition exceeding the safe capacity of the second type of structural member.

In an embodiment the position determined for the transition is a position at which the length of the first structural member is no more than 150% greater than the minimum length that allows said second type of structural member to be used at the transition without the required resistance at the transition exceeding the safe capacity of the second type of structural member.

In an embodiment the position determined for the transition is a position at which the length of the second structural member is at least ten times the length of the first structural member.

In an embodiment the position determined for the transition is a position at which the length of the second structural member is at least eight times the length of the first structural member.

In an embodiment the position determined for the transition is a position at which the length of the second structural member is at least six times the length of the first structural member.

In an embodiment the position determined for the transition is a position at which the length of the second structural member is at least four times the length of the first structural member.

In an embodiment the position determined for the transition is a position at which the length of the second structural member is at least twice the length of the first structural member.

In an embodiment the position determined for the transition is a position at which the length of the second structural member is at least 1.5 times the length of the first structural member.

In an embodiment the position determined for the transition is a position at which the length of the second structural member is at least equal to the length of the first structural member.

It will be appreciated that features or characteristics described above in relation to embodiments of any of the above aspects may be incorporated into any of the other aspects.

BRIEF DESCRIPTION OF THE DRAWINGS

Embodiments will be described below, in detail, with reference to accompanying drawings. The primary purpose of this detailed description is to instruct persons having an interest in the subject matter of the invention how to carry the invention into practical effect. However, it is to be clearly understood that the specific nature of this detailed description does not supersede the generality of the preceding Summary. In the accompanying diagrammatic drawings.

DETAILED DESCRIPTION OF EMBODIMENTS

With reference to FIGS. 1 to 9 embodiments of a composite structural member in accordance with the present disclosure will be described.

The description includes an embodiment of a portal frame, described below with particular reference to FIG. 1, which includes one or more composite structural members in accordance with the present disclosure, and an embodiment of a building, shown schematically in FIG. 2, which includes one or more such portal frames.

Figure 1:
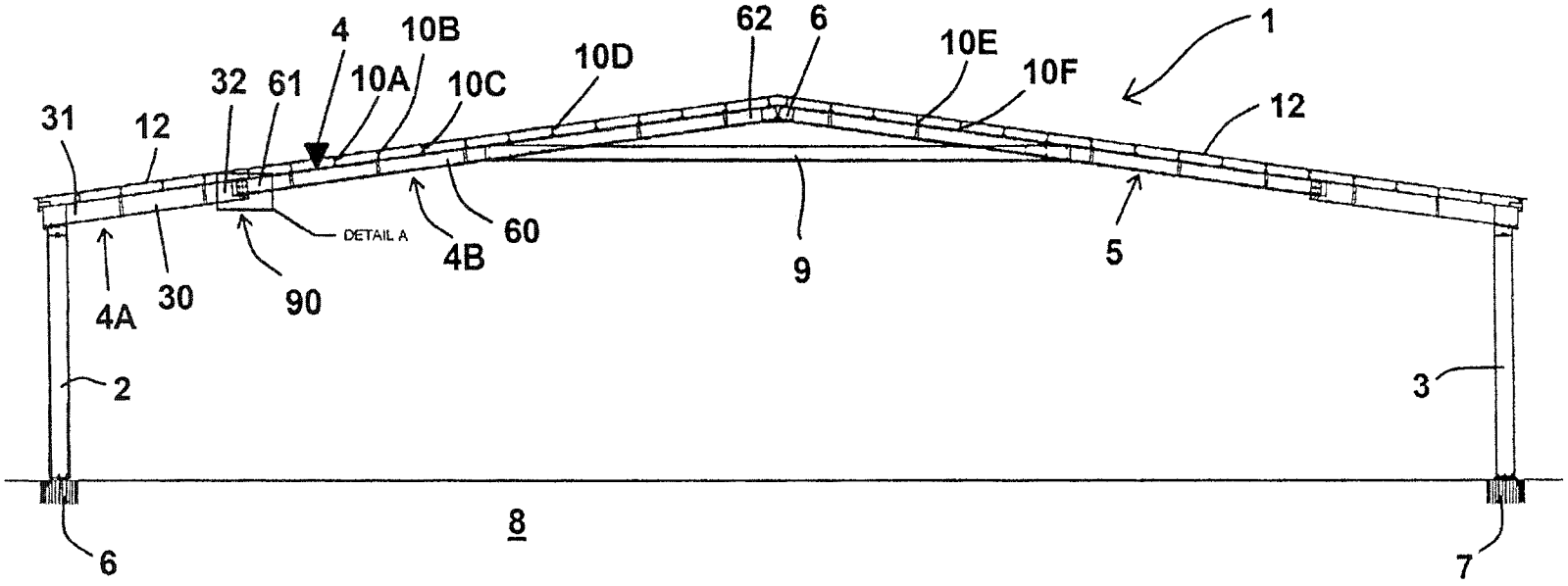
FIG. 1 is a schematic illustration of a portal frame including an embodiment of a composite structural member in accordance with the present disclosure, in use.

With particular reference to FIG. 1, an embodiment of a portal frame 1 comprises first and second substantially vertical support portions, which in this embodiment are in the form of vertical columns 2, 3.

Columns 2, 3 are, in this embodiment formed from universal beams (sometimes called UBs, I-beams, H-beams, or RSJs). Such beams, per se, are well known in the building industry, and in general terms comprise a web between two parallel flanges or chords to provide a beam with a cross sectional shape reminiscent of an upper case letter 'I' or 'H'.

The portal frame 1 further comprises first and second rafters 4, 5, which extend inclined upwardly from the tops of the respective columns 2, 3 to an apex 6 where the first and second rafters 4, 5 are connected together.

In use, the columns 2, 3 may be securely attached to foundations 6, 7 so that they are securely attached to the ground 8.

The rafters 4, 5 may be mutually connected by one or more braces to supplement and support their connection at the apex, and in this embodiment are connected by a brace in the form of a ridge tie 9.

The rafters 4, 5 may be provided with roof mounting brackets or cleats, for example brackets 10A, 10B, 10C, 10D, 10E, 10F. The brackets facilitate attachment of purlins, for example purlins 11A, 11B, 11C, shown in FIG. 2, to the rafters. The purlins 11A, 11B, 11C, may be used to support roof cladding 12.

Figure 2:
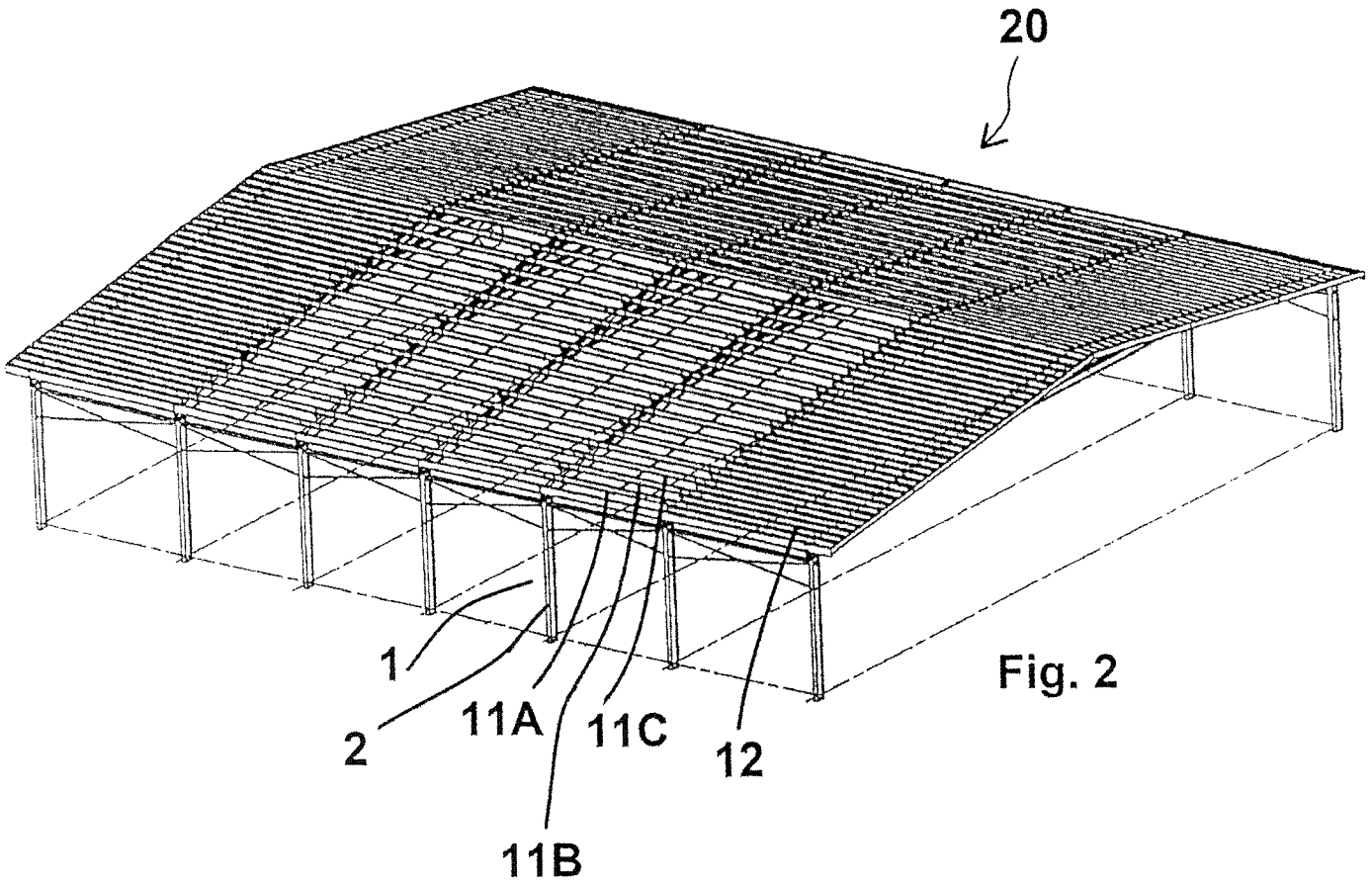
FIG. 2 is a schematic isometric view of an example of a building comprising a number of portal frames as illustrated in FIG. 1.

As foreshadowed above, FIG. 2 illustrates a building, designated generally by the reference numeral 20, comprising a number of portal frames one or more of which correspond to the portal frame 1 of FIG. 1.

Notably, in the illustrated embodiment of a portal frame, designated generally by the reference numeral 1, each of the rafters 4, 5 comprises an embodiment of a composite structural member in accordance with the present disclosure. This will be described in more detail with reference to the rafter 4, although it will be appreciated that, at least in the illustrated embodiment of portal frame 1, the rafter 5 is substantially identical thereto.

As shown in FIG. 1, the rafter 4 comprises a first elongate portion 4A, which in this embodiment comprises a first elongate structural member in the form of a first member 30, and a second elongate portion 4B, which in this embodiment comprises a second elongate structural member in the form of a second member 60. The first member 30 has a first end region 31 and a second end region 32. The second member 60 has first end region 61 and a second end region 62.

The first end region 31 of the first member 30 is attached to an upper part of the first column 2.

Connection of rafters to columns of a portal frame is known per se, and the attachment of the first end region 31 of the first member 30 to the upper part of the first column 2 may be of any suitable construction or means, including by means of a suitable haunch or other suitable known arrangement.

The second end region 32 of the first member 30 is attached to the first end region 61 of the second member 60 at a connection 90. An embodiment of the connection 90 will be described in more detail in due course.

The second end region 62 of the second member 60 terminates substantially at the apex 6 (where it is connected to the second rafter 5). Connection of rafters at the apex of a portal frame is known per se, and the connection of the rafters 4, 5 at the apex 6 may be of any suitable construction or means, including by means of an apex haunch or another known arrangement.

The first and second members 30, 60 are different types of member.

The first member 30, which forms the first elongate portion 4A of the rafter 4 (or, more generally, the first elongate portion of a composite structural member) is engineered or selected to be of a type which effectively and efficiently resist forces which this first elongate portion of the rafter 4 (or, more generally, first elongate portion of the composite structural member) is required to resist.

The second member 60, which forms the second elongate portion 4B of the rafter 4 (or, more generally, the second elongate portion of a composite structural member) is engineered or selected to be of a type which effectively and efficiently resist forces which this second portion of the rafter (or, more generally, this second portion of the composite structural member) is required to resist.

In this embodiment the second member 60 is of a type which is not capable of effectively resisting the forces which the first portion 4A of the rafter 4 is required to resist. However, the second member 60 is of a type which, when used in the second elongate portion 4B of the rafter 4, provides a benefit over using a member corresponding to the first member 60 to provide the second elongate portion 4B. For example, in this embodiment a benefit provided is that the second member 60 is of lower cost per unit length than the first member 30.

More specifically, in this embodiment the first member 30 is engineered or selected to be capable of resisting high-magnitude bending moments which are present at and in the region of the connection of a rafter of a portal frame to a column of a portal frame. These forces result from a number of factors including the weight of the rafters and roof, loads caused by wind pressure (including up-lift forces) and the transfer of these loads from the rafter to the column.

In contrast, the second member 60 will, in use, be subject to forces which are present at, and closer to, the apex region of a rafter of a portal frame. These forces differ from the forces at and close to the column. The bending moments which are present at and closer to the apex region of a rafter of a portal frame are typically of smaller magnitude than those in the region of the connection of the rafter to a column of a portal frame. In this embodiment, the second member 60 is engineered or selected to effectively and efficiently resist the bending moments which this second portion of the rafter is required to resist, but has a lower resistance to bending moments than does the first member 30, and is not capable of effectively resisting the bending moments which the first portion 4A of the rafter 4 is required to resist.

In an embodiment, as will be described in more detail in due course, the first member 30 comprises a hot-rolled mild steel universal beam, and the second member comprises a cold formed high tensile steel, back-to-back C-section (or lipped channel section) beam.

Thus, in this embodiment the first and second members 30, 60 are different types of member by virtue of: being of different construction; being made of different materials (specifically different grades or types of steel); and being made by different manufacturing methods (specifically hot-roll as against cold-forming, respectively) which contribute to imparting different characteristics to the respective members.

Selection of suitable types of member for the first and second members 30, 60 thus enables provision of an elongate composite structural member for a building structure, in which different portions along its length are well adapted to resist the forces which they are expected to be required to resist in use, but which are not unnecessarily capable of resisting other types of force. This allows provision of an efficiently and economically constructed composite structural member and, in the illustrated embodiment, an efficiently and economically constructed composite structural member in the form of a composite rafter 4.

Figure 3:
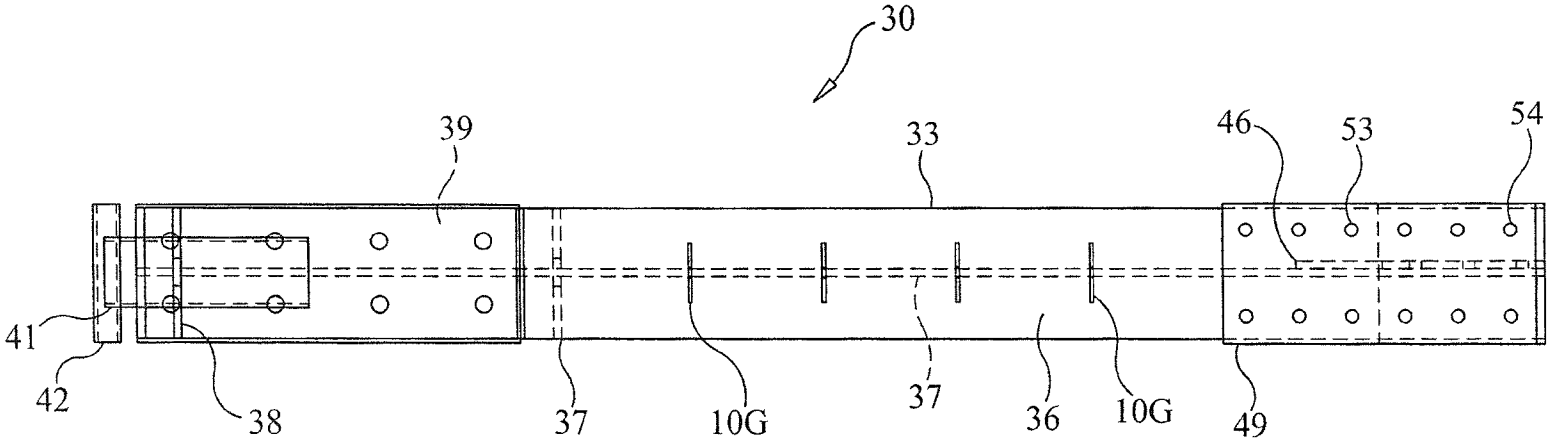
FIG. 3 is a schematic top plan view of an embodiment of a first elongate member which provides an embodiment of a first elongate portion of the composite structural member shown in FIG. 1.
Figure 4:
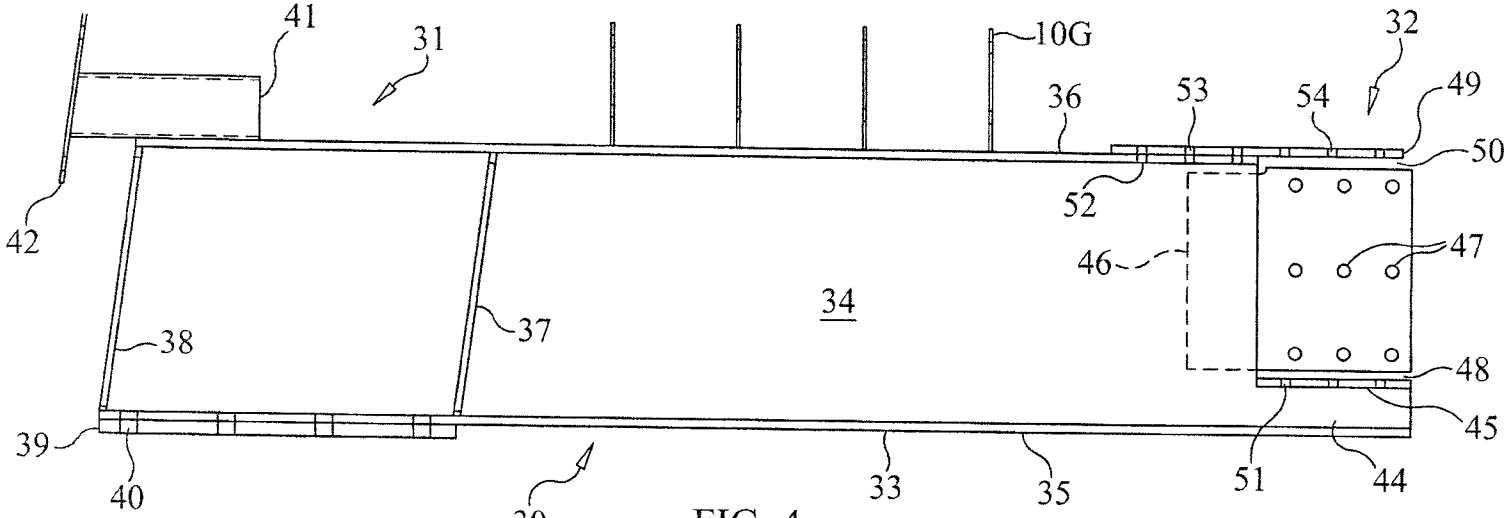
FIG. 4 is a schematic side view of the first elongate member of FIG. 3.
Figure 5:
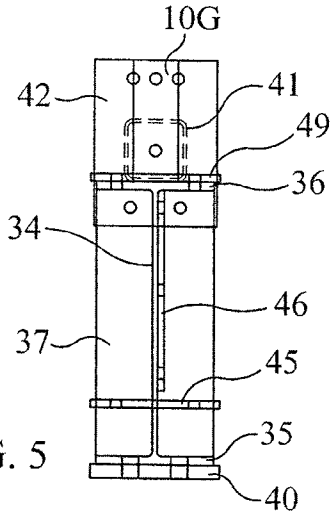
FIG. 5 is a schematic end view of the first elongate member of FIGS. 3 and 4.

FIGS. 3 to 5 illustrate an example embodiment of the first member 30, which will now be described in detail. However, it should be appreciated that other types of first member could be used without departing from the general teaching hereof in relation to the rafter 4 and portal frame 1 of FIG. 1. FIG. 3 is a schematic top plan view of the first member 30, FIG. 4 is a schematic side view, and FIG. 5 is a schematic end view.

The first member 30 comprises a universal beam 33, having a web 34 which extends between a first flange 35, which is a lower flange in use, and a second flange 36, which is an upper flange in use. The web 34 is connected to the flanges along their lateral centre lines so that an equal amount of each flange extends laterally away from each of the web 34. The universal beam 33 is substantially uniform along most of its length, and may be provided with brackets/cleats, for example bracket 10G, for connecting purlins thereto.

In this embodiment the universal beam 33 is formed from grade 250 (G250) to grade 350 (G350) hot rolled mild steel. The combination of universal beam shape (of appropriate cross sectional dimensions) and this grade of mild steel has been found capable of providing the desired resistance to high-magnitude bending moments to which parts of a portal frame rafter which are close to the column are subject. In an embodiment the universal beam 33 has a mass per unit length of about 60 to 70 kg per metre.

At the first end region 31 of the first member 30, the universal beam 31 is provided with stiffener plates 37, 38, 39 to allow suitable connection to a column (for example column 2) of a portal frame. The stiffener elements may be in the form of steel plates dimensioned and positioned to allow a suitably strong connection to the column. The connection itself may be provided, for example by bolting and/or welding one or more of the stiffener elements 37, 38, 39 and/or the universal beam 31, and/or one or more further connecting elements (not shown) to the column. The illustrated stiffener element 39 is provided with a number of apertures 40 to receive bolts used for connection to the column.

The first end region 31 of the first member 30 is further provided with a steel section 41 which supports a fascia cleat 42 for mounting a fascia to the building.

Connection of steel rafters to steel columns to form joints (including, but not necessarily haunch joints) of portal frames is known per se, and it will be appreciated that any suitable arrangement could be substituted for the illustrated arrangement if desired. Welding, as well as bolting is preferably used in the joints as will be appreciated by the skilled addressee.

The second end 32 of the first member 30 is provided with an arrangement for assisting connection of the first member 30 to the second member 60. The arrangement comprises an axial extension 44 of the universal beam 33 which comprises a length of the first flange 35 part of the web 34. In the illustrated embodiment the web 34 part of the extension 44 comprises approximately 20% of the height of the web 34. The extension may be formed by removing a piece of the universal beam 33, rectangular in side view, which includes a length of the second (upper) flange 36 and a rectangular piece of the web which has approximately 75-80% of the web height. An extension flange 45 is attached to the upper edge of the web which forms the extension 44. The extension flange 45 may have the same width and thickness, and may be oriented parallel to, the first and second flanges 35, 36.

In use, when the first and second members are being connected (which will typically occur in situ) the extension flange 45 can act as a support for the first end 61 of the second member 60 during final positioning and securing of the second member 60 relative to the first member 30.

The second end 32 of the first member is further provided with a connection member 46, which in this embodiment is in the form of a metal plate having a number of apertures 47 suitable for receiving therethrough fasteners, such as bolts, for securing the second member 60 to the first member 30.

The connection member 46 is attached (for example by welding and/or bolting, and in this embodiment by welding) to a side of the web 34 so that it extends above the extension, parallel to the web 34, but slightly laterally offset therefrom. (Thus a central web of the second member 60 may abut a side of the connection member 46 and be substantially aligned with the web 34 of the first member 30, as will be described in more detail in due course.) A gap 48 is provided between the connection member 46 and the extension flange 45 to accommodate part of the second member 60.

The part of the connection member 46 which is welded to the web 34 (which is on the 'far' side of the web 34 as illustrated in FIG. 5 and accordingly shown in broken lines) preferably overlaps the web 34 by a distance at least as great as the width of each side of the flanges 35, 36, to provide adequate connection strength.

FIGS. 3 to 5 further show a top plate 49, which in use overlies at least part of the second flange 36, extends above the extension 44 and which can be secured to the second flange 36 and to the second member 60. While the top plate 49 may be secured to the first member 30 prior to positioning of the second member 60 relative to the first member 30, this may obstruct positioning, and it is considered preferable to secure the top plate 49 to the members 30, 60 after they have been positioned relative to each other.

In this embodiment various parts are provided with apertures to facilitate securing of the first member 30 to the second member 60 using fasteners such as bolts. As mentioned above, the connection member 46 is provided with a number of apertures 47 (in this embodiment nine such apertures). The extension flange 45 is provided with a number of apertures 51 (in this embodiment six such apertures, three on each side of the web 34). The second flange 36 is provided with a number of apertures 52 to facilitate securing to the top plate 49 (in this embodiment six such apertures, three on each side of the web 34). The top plate 49 is provided with number of apertures 53 to facilitate securing to the second flange 36 (in this embodiment six such apertures, alignable with apertures 52) and a number of apertures 54 to facilitate securing to the second member 60 (in this embodiment six such apertures).

It will, of course be appreciated that the numbers of apertures can be selected as required. The spacing and distribution of the apertures may, of course, also be varied as required or desired. For example, in one variation the number of apertures 47 provided in the connection member 46 could be varied: for example twelve, rather than nine, such apertures could be provided, which could (upon assembly, such as along the lines described below) provide greater strength to this part of the connection 90. This may, depending on the circumstances, lead to a connection in which the additional strength provided by the top plate 49 is not required, so that the top plate could be omitted. The use of fasteners which extend through previously formed apertures is considered desirable, not least because this requires alignment of the previously formed apertures, which helps ensure that the various parts are positioned relative to each other as required. (In a variation to the described embodiment fasteners other than bolts, for example rivets, could be used.) However, means of securing the various parts other than fasteners which extend through previously formed apertures, such as welding, could be used if desired. It should be appreciated that variations or alternatives to the connection part of the embodiment of the first member 30 illustrated, and described above with reference to the drawings, may require corresponding and/or complementary alternative to or variations of other parts of the composite structure (e.g. rafter 4), for example the second member 60 described in detail below.

In FIGS. 3 and 4 the discontinuities in the horizontal lines running in the axial length direction of the first member 30 indicate that some lengths of the first member 30 which are uniform and identical in shape and features to immediately adjacent parts have been omitted in order to reduce the illustrated length of the first member 30 while maintaining its transverse width and height at a scale that allows features to be seen in the drawings. In an embodiment the first member is about 4 metres long, is about 205 mm in width (including the flanges 35, 36) and about 470 mm in height. Thus compared to a scale drawing the first member 30, as illustrated is shown in FIGS. 3 and 4 reduced in length by about 35%.

Figure 8:
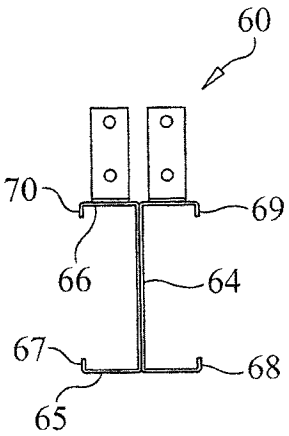
FIG. 8 is a schematic end view of the second elongate member of FIGS. 6 and 7.
Figure 6:
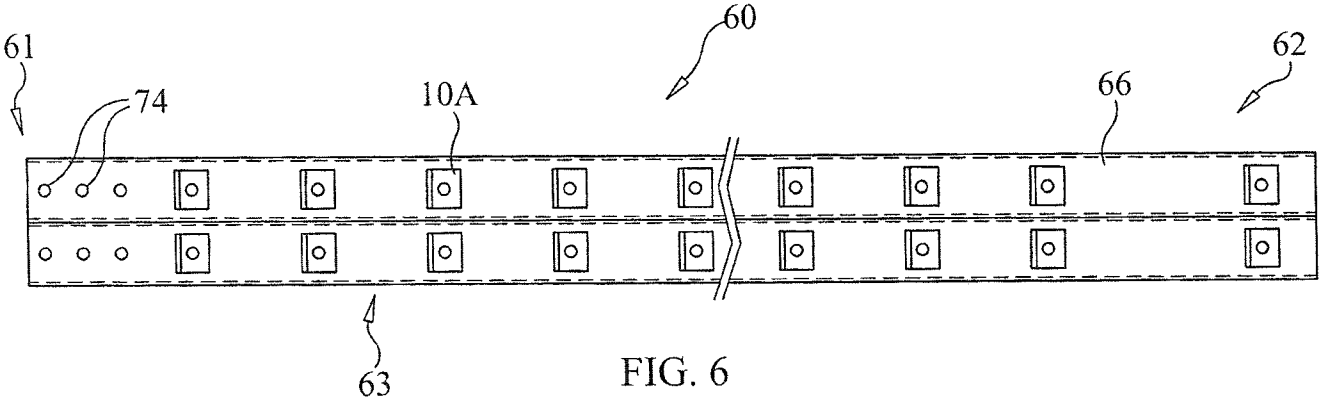
FIG. 6 is a schematic top plan view of an embodiment of a second elongate member which provides an embodiment of a second elongate portion of the composite structural member shown in FIG. 1.
Figure 7:
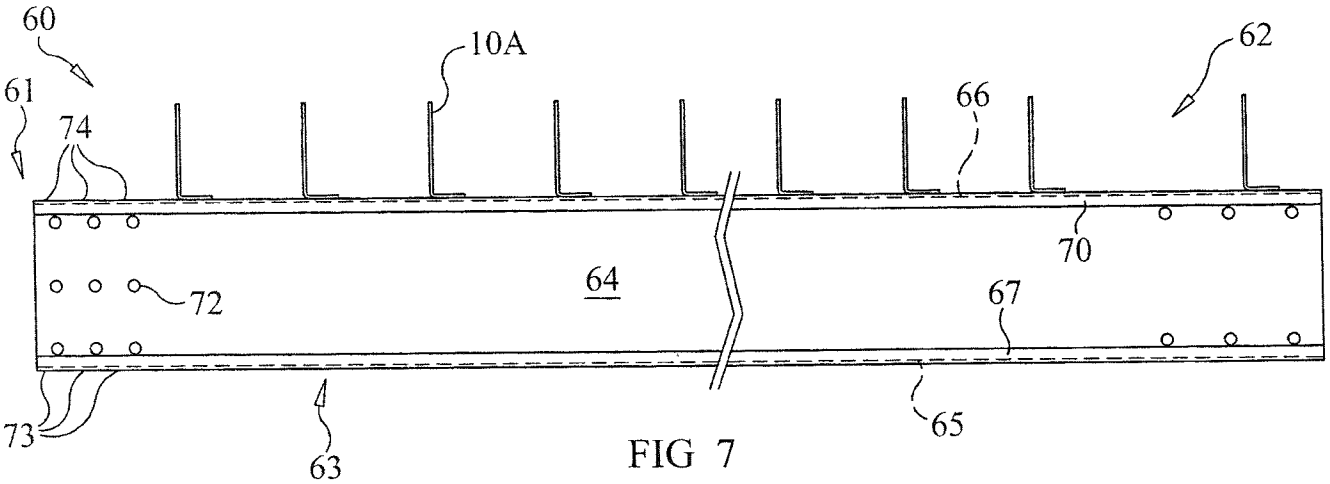
FIG. 7 is a schematic side view of the second elongate member of FIG. 6.

FIGS. 6 to 8 illustrate an example embodiment of the second member 60, which will now be described in detail. However, it should be appreciated that other types of second member 60 could be used without departing from the general teaching hereof in relation to the rafter 4 and portal frame 1 of FIG. 1.

The second member 60, as illustrated in FIGS. 6 to 8, comprises an elongate beam 63 formed, in this embodiment by two steel C-sections welded (or otherwise suitably attached) back to back, as best shown in FIG. 8. The elongate beam 63 may therefore be regarded as having a web 64 which extends between a first flange 65, which is a lower flange in use, and a second flange 66, which is an upper flange in use. The web 64 is formed by the backs of the two C-sections, and therefore has twice the thickness of the flanges 65, 66.

Further, the C-sections provide each flange 65, 66 with a perpendicularly depending lip or flange extension 67, 68, 69, 70 along each lateral edge thereof.

In this embodiment the C-sections, and thus the elongate beam 63, are formed from grade G450 to G550 cold rolled high tensile, 3 mm gauge steel. In an alternative form of description the C-sections, in this embodiment, may be C350-30 sections.

The gauge of the steel from which the C-sections are formed is significantly lighter than the gauge of the steel from which the universal beam 33 forming the first member 30 is fabricated.

The elongate beam 63 is therefore (in this embodiment) in the form of a compound beam section, comprising two lipped channels (C-sections) connected (welded) back-to-back. Such compound beam back-to-back lipped channel sections are known per se.

In the described embodiment the elongate beam 63 has a mass per unit length of about 14 to 17 kg per metre.

The shape and structure of the elongate beam 63 (of appropriate cross sectional dimensions) in combination with this grade of cold formed steel section has been found to provide suitable characteristics for forming the second member. In particular, it has been found to provide a useful combination of adequate resistance to bending moments and low cost, as will be described in more detail hereafter. It will be appreciated that the elongate beam 63 would not be suitable for forming the part of the rafter 4 which connects to the column 2, as it would not have adequate resistance to bending moments.

The first end region 61 of the second member 60 is provided with an arrangement for facilitating secure connection to the first member 30. In this embodiment the arrangement comprises a plurality of apertures. More specifically, in this embodiment, at the first end region 61 the web 64 is provided with nine apertures 72 which can be aligned with the apertures 47 of the connection member 46. Further, in this embodiment, at the first end region 61 the first flange 65 is provided with six apertures 73 which can be aligned with apertures 51 of the extension flange 45. Further, in this embodiment, at the first end region 61 the second flange 65 is provided with six apertures 74 which can be aligned with apertures 54 of the top plate 49 (while the apertures 53 of the top plate 49 are aligned with the apertures 52 of the second flange 36 of the first member 30).

The second end region 62 of the second member 60 is provided with an arrangement for facilitating secure connection of the second member at the apex 6 of the portal frame 1. In this embodiment the arrangement comprises a plurality of apertures 75.

In FIGS. 6 and 7 the discontinuities in the horizontal lines running in the axial length direction of the second member 60 indicate that some lengths of the second member 60 which are substantially uniform and identical in shape and features to immediately adjacent parts have been omitted in order to reduce the illustrated length of the second member 60 while maintaining its transverse width and height at a scale that allows features to be seen in the drawings. In an embodiment the second member 60 is about 11 metres long, about 250 mm in width (including the flanges 65, 66) and about 350 mm in height. Thus compared to a scale drawing the second member 60, as illustrated is shown in FIGS. 6 and 7 reduced in length by about 60%.

Figure 9:
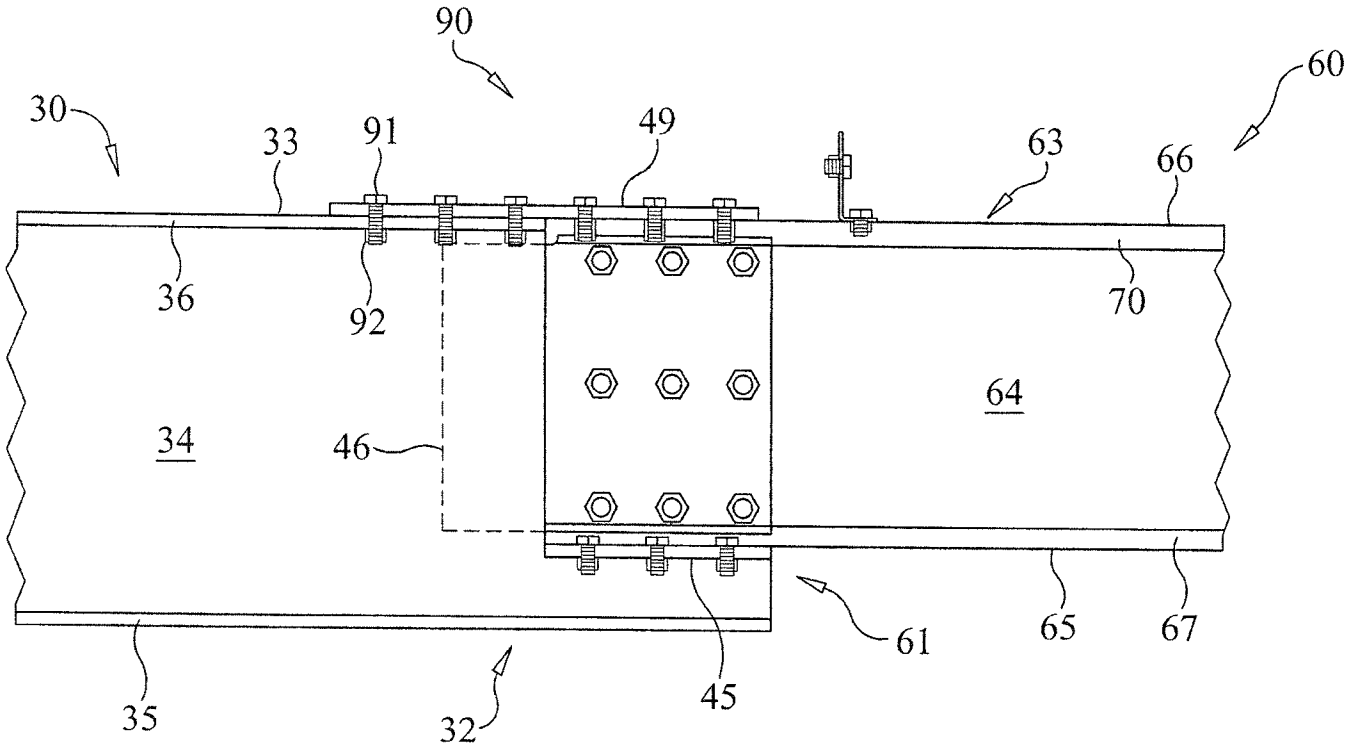
FIG. 9 is a side view of an embodiment of a connection which may be used between first and second elongate members of the composite structural member shown in FIG. 1.
Figure 10:
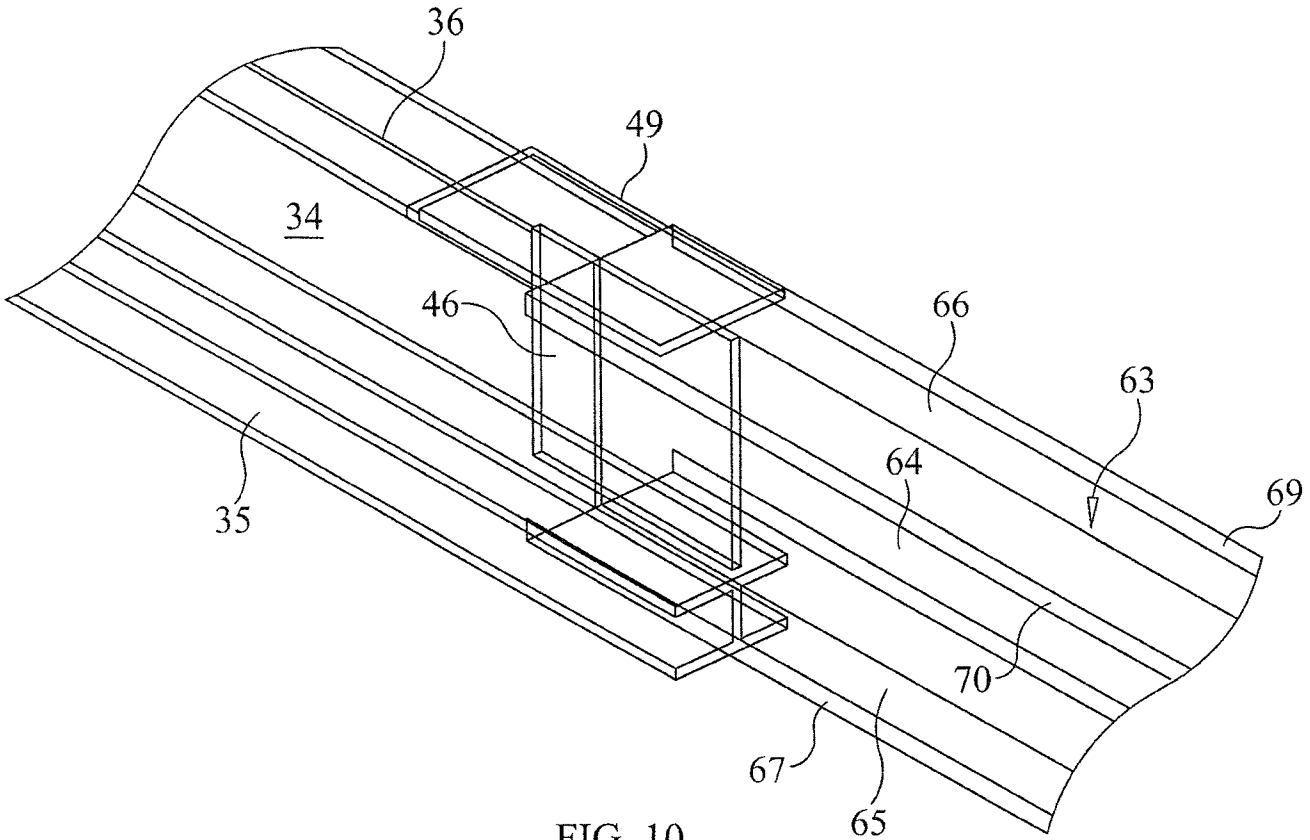
FIG. 10 is a schematic isometric view showing some of the parts of the connection shown in FIG. 9.

FIGS. 9 and 10 illustrate an embodiment of a connection 90, in which the first member 30, as described above with reference to FIGS. 3 to 5 and the second member 60, as described above with reference to FIGS. 6 to 8 are secured together, at their respective second and first end regions 32, 61 to provide an embodiment of a composite structural member in accordance with the present disclosure.

With reference to FIG. 9, the second end region 32 of the first member 30 and the first end region 61 of the second member 60 have been brought together, and positioned so that the various apertures described above align, allowing a fastener such as a bolt to be inserted through each pair of aligned apertures. In practice this would likely be performed by moving the second member 60 to the first member 30, and allowing the end region of the first flange 65 of the second member to come into contact with the extension flange 45 of the first member 30. Then the second member 60 is moved to position the web 64 of the second member 30 beside the connection member 46 and end to end with the web 34 of the first member 30, to position the first flange 65 of the second member 30 in the gap 48 between the extension flange 45 and the connection member 46, and the second flange 66 of the second member 60 above the connection member 46 and end-to-end with the second flange 36 of the first member 30. When positioned correctly in this manner the apertures 72 of the web 64 of the second member 60 will align with the apertures 47 of the connection member 46, and the apertures 73 of the first flange 65 of the second member 60 will align with the apertures 51 of the extension flange 45 of the first member 30. Positional adjustments may be made if required to provide alignment of the apertures. Fasteners are then passed through each pair of aligned apertures. Bolts may be used and secured by nuts. The top plate 49 is then positioned so that the apertures 53 thereof align with apertures 52 in the second flange 36 of the first member 30, and so that the of the apertures 54 of the top plate 49 align with apertures 74 in the second flange 66 of the second member 60. Fasteners are then passed through each pair of aligned apertures. Bolts may be used and secured by nuts.

FIG. 9 shows the connection 90 complete, with respective bolts, for example bolt 91 extending through respective pairs of aligned apertures and secured by respective nuts, for example nut 92.

FIG. 10 is a schematic isometric representation of the connection 90 with all parts shown transparent and with apertures, nuts and bolts omitted.

Figure 11:
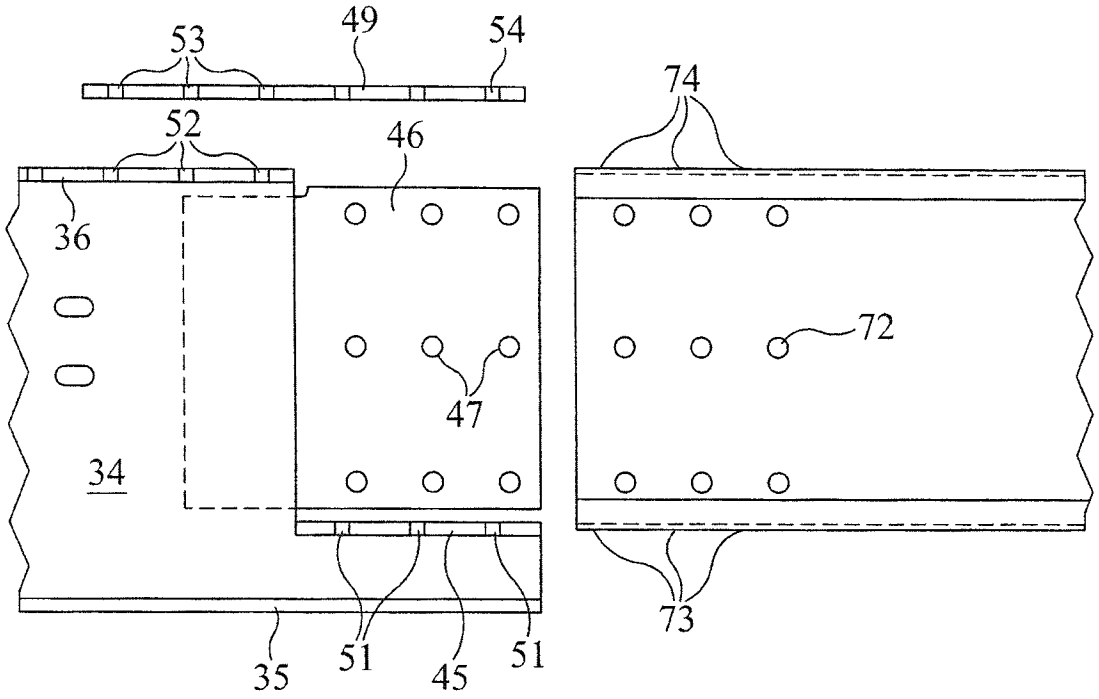
FIG. 11 is an exploded view of the connection of FIG. 10 with nuts and bolts omitted.

FIG. 11 is an exploded view of the connection with nuts and bolts omitted.

It will be appreciated that the above described embodiment provides a composite structural member for a building which can enhance performance and economy by providing different materials and structures at different points along the length of the structural member, each appropriate for the loads to be borne at those points. More specifically, using the example of a rafter for a portal frame, a material and structure suitable for resisting high-magnitude bending moments (and provided by the first member 30) is used close to the column, and a material and structure less incapable of resisting such high-magnitude bending moments is used closer to the apex.

In the described embodiment the first member is approximately 4 metres long, and the second member is approximately 11 metres long, to provide a composite structural member which is approximately 15 metres long. The first member makes up approximately 25% to 30% of the length of the composite structural member, and the second member makes up about 70% to 75% of the length of the composite structural member. These percentages may vary according to the situation and choices of structures and materials.

However, as will be illustrated in detail below, it has been found that the bending moments to which a portal frame is subject reduce rapidly with distance from the column and the joint where the rafter connects to the column. The need to provide a part of the rafter which is well adapted to resisting high-magnitude bending moments is therefore most acute close to where the rafter connects to the column. For reasons which will be explained below, at least in the illustrated embodiment it will often be appropriate for the member or part that is well adapted to resisting high-magnitude bending moments to be considerably shorter than the member or part that is less well adapted to resisting such forces.

As mentioned above, in relation to provision of a composite rafter for a portal frame, a benefit of providing such a composite rafter is that instead of a rafter comprising a substantially uniform length of a member of high cost per unit length which can resist the high-magnitude bending moments which occur at and close to where the rafter connects to the column, only a relatively of such a member need be provided, and the remainder of the rafter length may comprise a member which is of lower cost per unit length.

In the embodiment described with reference to FIGS. 3 to 8 in particular, the first member 30 is considerably more expensive per unit length than the second member 60. In some portal frame applications it is possible to use a relatively inexpensive member, such as a member of the same type as elongate beam 63 (of second member 60) as a rafter. However, as the required length of the rafter increases it becomes increasingly difficult to source or engineer a member of low cost per unit length which is capable of resisting the high-magnitude bending moments at and close to the portal frame column. Rafter length is not the only factor that contributes to the magnitude of the bending moments that a rafter is required to resist, and other factors include wind loading, roofing material weight and 'live' load (which may be regarded as additional load that the building structure is occasionally required to resist, such as the weight of people on the roof of the building). However, by way of an approximate indication, it can be considered that it is difficult to cost-effectively source cold formed beams suitable for rafter lengths in excess of about 12 to 14 metres, and use of hot rolled members such as UBs is generally preferred for longer rafter lengths.

In order to cost effectively provide rafters it is normally important not to use beams which have a load capacity greatly above the required capacity (taking into account safety margins). Thus it is important to ascertain the required resistance to forces of the rafter to be provided. Where a single uniform beam is to be used, the maximum required resistance to forces of the rafter can be used as the requirement for the beam which forms the rafter. In relation to bending moments this will generally be the bending moment resistance requirement at or close to the column. Where a composite rafter in accordance with the present disclosure is to be used it is important to ascertain the required resistance to forces of the rafter along the rafter length. This can allow assessment of what types of beam or member are required, and assessment of an appropriate position along the rafter length to provide the connection at which the composite rafter transitions from the first member (e.g. first member 30) to the second member (e.g. second member 60).

Engineering software is known which can provide required resistances to forces, of a portal frame, at any specified region of the columns and rafters, taking into account the various factors involved including those described above (such as wind loading and live weight). Such software is a standard tool used by structural engineers.

Figure 12:
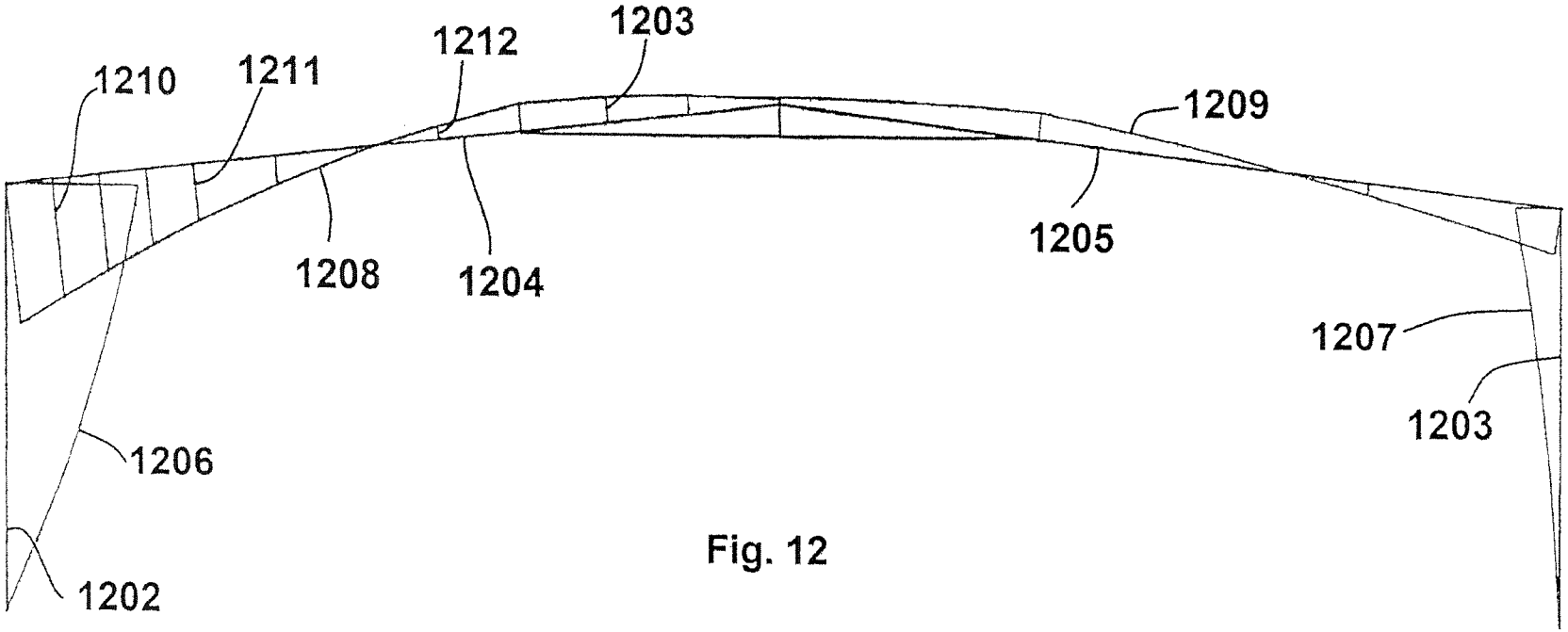
FIG. 12 is an example of a diagram illustrating bending moment resistance requirements for a particular required portal frame, having particular requirements.

FIG. 12 is an example of a diagram, for a portal frame with a 15 m span, and specified wind loading and 'live' load, showing the magnitude of the bending moments which the columns and rafters are required to be capable of resisting at all points along their lengths.

In FIG. 12, vertical lines 1202, 1203 represent the columns (e.g. columns of a portal frame corresponding generally to the positions of columns 2, 3 in FIG. 1) and inclined lines 1204, 1205 represent the rafters (e.g. rafters of a portal frame corresponding generally to the positions of rafters 4, 5 in FIG. 1). Curves 1206, 1207 represent the bending moments which the columns 1202, 1203, respectively are required to resist, and curves 1208, 1209 represent bending moments which the rafters 1204, 1205, respectively are required to resist. The magnitude of the required bending moment at each point along the lengths of the columns and rafters is indicated by the distance of the respective curve 1206, 1207, 1208, 1209 normal to that point on the respective line 1202, 1203, 1204, 1205. Asymmetry is a result of an asymmetric wind load requirement. Although not shown in FIG. 12 numerical values for the bending moments which the columns 1202, 1203 and the rafters 1204, 1205 are required to resist can be provided by the software for any point. Some lines 1210, 1211, 1212, 1213, normal to the line 1204 which represents a rafter, are included by way of example: the length of each respective line 1210, 1211, 1212, 1213 indicates the magnitude of the bending moment that the rafter is required to resist at the point along the length of the rafter where the respective line intersects the line 1204.

Figure 13:
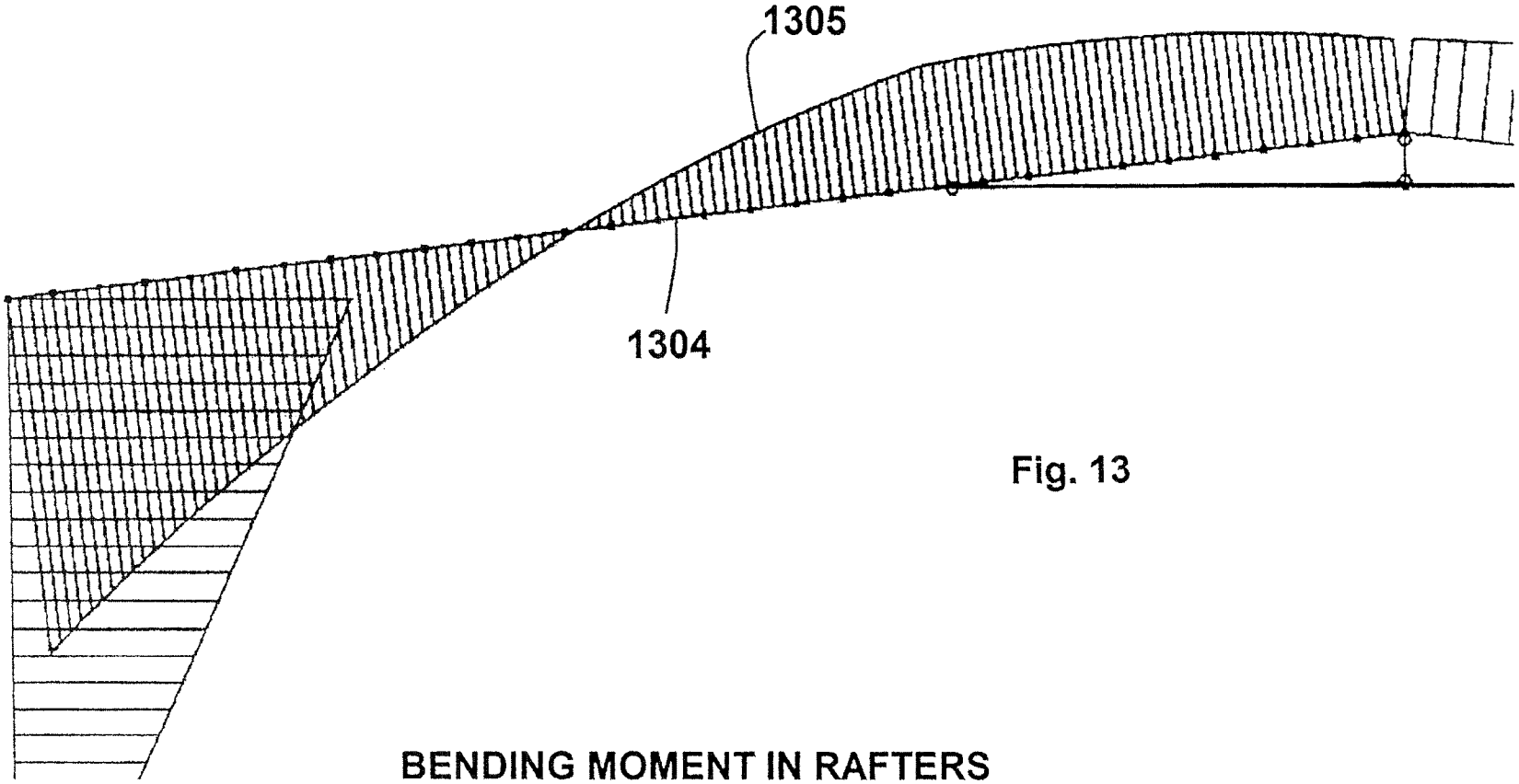
FIG. 13 is a diagram illustrating bending moment resistance requirements for a part of a portal frame, having different requirements to that of FIG. 12.

FIG. 13 shows a diagram of similar type to the diagram of FIG. 12, but showing only part of a portal frame, and with forces arrived at using different requirements for wind loading and live weight. Inclined line 1304 represents the rafter 4 of FIG. 1. Curve 1305 represents the magnitudes of the bending moments which the rafter 4 is required to resist. Lines normal to the line 1304 represent the magnitudes of the bending moments which the rafter 4 is required to resist, and represent increments of one eighth of a metre (125 mm) along the length of the rafter 4.

Figure 14:
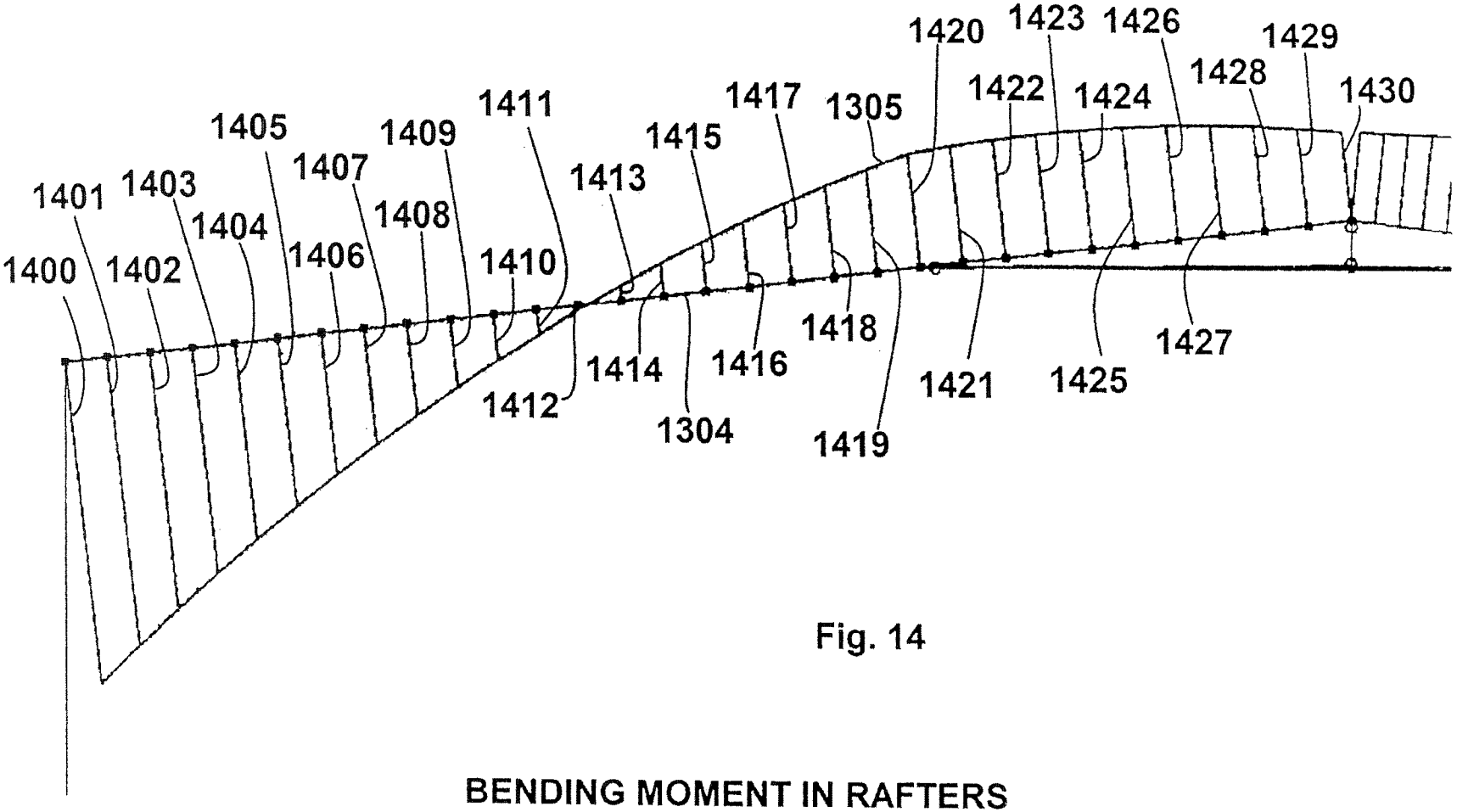
FIG. 14 is a diagram corresponding to the diagram of FIG. 13, but with various elements removed to enhance clarity.

For simplicity, only the forces at half metre increments along the length of the rafter 4 will be considered in detail. FIG. 14 shows the lines representing the magnitudes of the bending moments which the rafter 4 is required to resist at half metre increments. These lines, representing distances from the connection of the rafter 4 to its corresponding column ranging from zero (at the connection to the column) to 15 m (where the rafter terminates at the apex of the portal frame) at half metre increments are designated by reference numerals 1400 to 1430, respectively.

It is apparent from FIG. 14 that the magnitude of bending moment which the rafter 4 is required to resist is maximum at zero distance from the column (line 1400) and initially decreases rapidly with distance from the column (lines 1401 to, say, 1406 or three metres from the column). The magnitude then continues to decrease, but less rapidly (lines 1407 to 1412) and reaches zero at a point of conflexure (between lines 1412 and 1413, which is between 6 and 6.5 metres from the column). The magnitude then increases (with opposite sign, indicating that the bending moment is in the opposite direction, from lines 1413 to 1420) remains almost constant over a distance of about three metres (between lines 1420 and 1426) but peaking at about the centre of this region (line 1423) and then decreases fairly slowly over the two metres or so closest to the apex (lines 1426 to 1430).

The values of the magnitudes of bending moments which the rafter 4 is required to resist at each illustrated half metre increment are given in Table 1.

As mentioned above, knowledge of the values of the magnitudes of the bending moments which the rafter 4 is required to resist at each point along its length can allow assessment of what types of beam or member are required, and assessment of an appropriate position along the rafter length to provide the connection at which the composite rafter transitions from the first member (e.g. first member 30) to the second member (e.g. second member 60).

The first member must be capable of resisting the maximum magnitude of bending moment which the rafter 4 is required to resist. This effectively sets a minimum capacity (to resist bending moment) for the first member. A suitable member with such a capacity can be engineered or selected, bearing in mind cost and any additional requirements (such as corrosion resistance).

As mentioned above, an aim in this embodiment is to provide a cost effective composite member. As the first member is considerably more expensive per unit length it might be assumed that the first member should be kept as short as possible to maximise cost savings. However, as the magnitude of the bending moment decreases rapidly close to the column it is apparent that providing a first member of greater length will reduce the required capacity (to resist bending moments) of the second member. This may allow a second member of lower cost per unit length to be used, and the cost benefit associated with this may outweigh the cost saving of providing a very short first member.

If the different costs per unit length of different possible second members with different capacities (to resist of bending moments) are known, then the known variations in bending moment along the length of the rafter can be used to determine a cost effective point at which to locate the connection, or in other words cost effective lengths for the first and second members.

Table 1 provides an indicative calculation of the cost of the composite rafter 4 for different positions of the connection 90 between the first member 30 and the second member (e.g. 60) at each of the half metre increments along the length of the rafter. That is, for each of these putative positions of the connection, table 1 sets out an indicative cost of the first member, an indicative cost of the second member, and an indicative total cost of the rafter 4. This enables a cost effective combination of first and second member lengths to be selected.

It will be appreciated that the calculations set out in Table 1 are intended to be indicative only. Factors which affect these calculations, such as the relative cost of the first and second members, or of different possible second member types may vary over time. Further capacities of different types of possible second members may vary over time.

Further, it will be appreciated that the portal frame 1 includes a ridge tie 9, and it has been found that different lengths and types of second member require different types, lengths and costs of ridge tie. This variable is included in the calculations in Table 1, but again may vary.

Table 1 include ten columns, designated A to K.

Column A lists distances, in metres, along the rafter 4 from its corresponding column at half metre increments ranging from zero (at the connection to the column) to 15 m (where the rafter terminates at the apex of the portal frame).

Column B lists the magnitudes of the bending moments, in kNm which the rafter 4 is required to resist at each of the half metre increments listed in column A. The respective values in the thirty one rows of column B correspond to the bending moments indicated by the lengths of the thirty one lines 1400 to 1430 in FIG. 14.

Column C lists the length of the first member 30, in metres, for positions of the connection between the first member and the second member corresponding to the distance along the rafter 4 indicated by the corresponding row of column A.

Column D lists the cost of the first member, in Australian dollars, for each length listed in column C, assuming a cost of AU$240 per lineal metre.

Column E lists the length of the second member, in metres, for positions of the connection between the first member and the second member corresponding to the distance along the rafter 4 indicated by the corresponding row of column A.

Column F indicates the cost of the second member per lineal metre, in Australian dollars, for each length listed in column E. The costs are based on the assumption that the back-to-back beam 63 (of member 60) costs AU$64 per lineal metre and has a capacity to resist moment forces of 120 kNm (including safety margin). Where the second member is required to resist bending moments of greater than 120 kNm (including safety margin) it is assumed that additional parts must be included in the second member, for example additional channel sections welded to each side of the web 64 of beam 63 to enhance strength, and that this doubles the cost of the second member. Hence the stated cost per lineal metre is AU$128 in the third to seventh rows of column F (corresponding to bending moment magnitudes of between 141 kNm and 257 kNm). Where the second member is required to resist moment forces of greater than about 260 kNm it is assumed that no suitable or cost effective second (cold formed) member with such a capacity is feasible. Hence the designation N/A is stated in the first and second rows of column F (corresponding to bending moment magnitudes of between 289 kNm and 322 kNm).

Column G lists the cost of the second member, in Australian dollars, based on multiplying the corresponding length listed in column E and the corresponding cost per lineal metre listed in column F.

Column H lists the cost of the ridge tie, per rafter, for each length of second member listed in column E. Where the length of second member is 4.0 metres or less it is considered that the increased strength of the portal frame provided by the use of long (and strong) first members renders use of a ridge tie unnecessary.

Column I lists the cost of the rafter (including ridge tie) for each position of the connection between the first member and the second member corresponding to the distance along the rafter 4 indicated by the corresponding row of column A. The cost of the rafter is assumed to be the sum of the costs of the first member, the second member and the ridge tie (if any). Although other factors may also be relevant, such as the cost of providing and forming the connection and fasteners (and a possible transportation saving since less material, of less maximum length will need to be transported to the construction site), these other factors are ignored for the purposes of this indicative analysis. Any overlap between the first and second members is also ignored, and it is assumed that the lengths of the first and second members always sum to the total rafter length.

Column J lists the percentage saving afforded by provision of each considered variation of composite rafter compared to use of a uniform rafter corresponding to the first member and costing AU$240 per lineal metre, or AU$3600 for a 15 metre length (corresponding to the final row of the table, which affords a zero percent saving).

Column K lists the length of the first member as a percentage of the total rafter length. This may also be regarded as the position of the connection (the transition between the first and second members) along the rafter as percentage of the length of rafter.

TABLE 1

| A Dist from col (/m) | B Res/ kNm | C L. of 1st mem | D Cost of first Mem | E L. of 2nd Mem | F Cost/m of 2nd Mem | G Cost of 2nd Mem | H Ridge tie cost | I Total rafter cost | J % age saving over all hot roll UB | K 1st Mem % age length of rafter |
|---|---|---|---|---|---|---|---|---|---|---|
| 0 | −322 | 0 | 0 | 15.0 | N/A | N/A | | N/A | | 0 |
| 0.5 | −289 | 0.5 | 120 | 14.5 | N/A | N/A | | N/A | | 3.3 |
| 1.0 | −257 | 1.0 | 240 | 14.0 | 128 | 1,792 | 719 | 2,751 | 24 | 6.7 |
| 1.5 | −226 | 1.5 | 360 | 13.5 | 128 | 1,728 | 668 | 2,756 | 23 | 10.0 |
| 2.0 | −197 | 2.0 | 480 | 13.0 | 128 | 1,664 | 620 | 2,764 | 23 | 13.3 |
| 2.5 | −168 | 2.5 | 600 | 12.5 | 128 | 1,600 | 573 | 2,773 | 23 | 16.7 |
| 3.0 | −141 | 3.0 | 720 | 12.0 | 128 | 1,536 | 528 | 2,784 | 23 | 20.0 |
| 3.5 | −115 | 3.5 | 840 | 11.5 | 64 | 736 | 247 | 1823 | ***49*** | ***23.3*** |
| 4.0 | −91 | 4.0 | 960 | 11.0 | 64 | 704 | 226 | 1,890 | ***48*** | ***26.7*** |
| 4.5 | −67 | 4.5 | 1,080 | 10.5 | 64 | 672 | 206 | 1,958 | ***46*** | ***30.0*** |
| 5.0 | −45 | 5.0 | 1,200 | 10.0 | 64 | 640 | 187 | 2,027 | ***44*** | ***33.3*** |
| 5.5 | −23 | 5.5 | 1,320 | 9.5 | 64 | 608 | 168 | 2,096 | ***42*** | ***36.7*** |
| 6.0 | −4 | 6.0 | 1,440 | 9.0 | 64 | 576 | 151 | 2,167 | ***40*** | ***40.0*** |
| 6.5 | 15 | 6.5 | 1,560 | 8.5 | 64 | 544 | 135 | 2,239 | 38 | 43.3 |
| 7.0 | 32 | 7.0 | 1,680 | 8.0 | 64 | 512 | 119 | 2,311 | 36 | 46.7 |
| 7.5 | 48 | 7.5 | 1,800 | 7.5 | 64 | 480 | 105 | 2,385 | 34 | 50.0 |
| 8.0 | 63 | 8.0 | 1,920 | 7.0 | 64 | 448 | 91 | 2,459 | 32 | 53.3 |
| 8.5 | 77 | 8.5 | 2,040 | 6.5 | 64 | 416 | 79 | 2,535 | 30 | 56.7 |
| 9.0 | 89 | 9.0 | 2,160 | 6.0 | 64 | 384 | 67 | 2,611 | 27 | 60.0 |
| 9.5 | 100 | 9.5 | 2,280 | 5.5 | 64 | 352 | 56 | 2,688 | 25 | 63.3 |
| 10.0 | 110 | 10.0 | 2,400 | 5.0 | 64 | 320 | 47 | 2,767 | 23 | 66.7 |
| 10.5 | 113 | 10.5 | 2,520 | 4.5 | 64 | 288 | 38 | 2,846 | 21 | 70.0 |
| 11.0 | 115 | 11.0 | 2,640 | 4.0 | 64 | 256 | 0 | 2,896 | 20 | 73.3 |
| 11.5 | 116 | 11.5 | 2,760 | 3.5 | 64 | 224 | 0 | 2,984 | 17 | 76.7 |
| 12.0 | 115 | 12.0 | 2,880 | 3.0 | 64 | 192 | 0 | 3,072 | 15 | 80.0 |
| 12.5 | 114 | 12.5 | 3,000 | 2.5 | 64 | 160 | 0 | 3,160 | 12 | 83.3 |
| 13.0 | 111 | 13.0 | 3,120 | 2.0 | 64 | 128 | 0 | 3,248 | 10 | 86.7 |
| 13.5 | 106 | 13.5 | 3,240 | 1.5 | 64 | 96 | 0 | 3,336 | 7 | 90.0 |
| 14.0 | 101 | 14.0 | 3,360 | 1.0 | 64 | 64 | 0 | 3,424 | 5 | 93.3 |
| 14.5 | 94 | 14.5 | 3,480 | 0.5 | 64 | 32 | 0 | 3,512 | 2 | 96.7 |
| 15.0 | 86 | 15.0 | 3,600 | 0 | N/A | 0 | 0 | 3,600 | 0 | 100 |

Review of column J shows that a percentage cost saving in the region of approximately 40 to 49% can be provided, in this particular example, by use of a composite rafter in which the first member is between about 23% and about 40% of the rafter length. Clearly this represents a substantial saving. These values are indicated by use of a bold italic font in columns J and K.

The maximum saving, based on the assumptions set out and the results set out in Table 1 is about 49%, provided by a composite rafter in which the first member is about 23% of the rafter length. Notably, this also represents a composite rafter in which the second member extends to a position where it is required to resist a bending moment which is almost 100% of its maximum capacity. That is, the transition between the first member and the second member is at a point along the rafter where the bending moment that the rafter must be capable of resisting is 115 kNm, and the capacity of the second member, in this example, is 120 kNm (including safety margin), equating to an effective 'efficiency' of the second member of (100×115/120=) about 96%.

Evidently a further, small, cost saving could be obtained by reducing the length of the first member by a few centimetres, and extending the second member to the position where its efficiency is 100%.

It will be appreciated that although it is often desirable to maximise cost savings, even if the transition between the first member and the second member were provided at a point along the rafter where the cost saving is far from optimal a commercially valuable cost saving could potentially be obtained. For example, if the transition were half way along the composite rafter an indicated cost saving of some 34% could potentially be afforded.

It will also be appreciated that the lengths of the first and second members 30, 60 as described above, in relation to FIGS. 3 to 8, as being about 4 metres and about 11 metres, respectively, are consistent with the upper end of the cost savings as set out in Table 1.

It is worth noting that, to some extent, increasing the length of the first member can reduce the required capacity (to resist bending moments) of the second member, which may allow a second member of lower cost per unit length to be used. This is indeed the main reason why the cost saving indicated in Table 1 for a first member length of 3.5 metres is very much greater than for a first member length of 3.0 metres. However, it is worth noting that the second member must have a capacity sufficient to resist the magnitude of bending moment where it peaks in the half of the rafter closer to the apex (indicated by line 1423 in FIG. 14, and at 11.5 metres from the column in Table 1). In the embodiment of FIG. 14 and Table 1, therefore extending the first member beyond 3.5 metres in length (corresponding to a bending moment magnitude of 115 kNm) cannot serve to reduce the required capacity of the second member (which must be at least 116 kNm at 11.5 metres from the column).

If seeking to reduce the required capacity of the second member it is therefore important to consider the capacity required to meet the force resistance requirement where it peaks in the half of the rafter closer to the apex. That is, the required capacity of the second member cannot be reduced further by extending the first member (in the column half of the rafter) beyond the point where the magnitude of the force that must be resisted by the rafter is equal to the peak magnitude of the force that must be resisted by the rafter in the apex half of the rafter.

Figure 15:
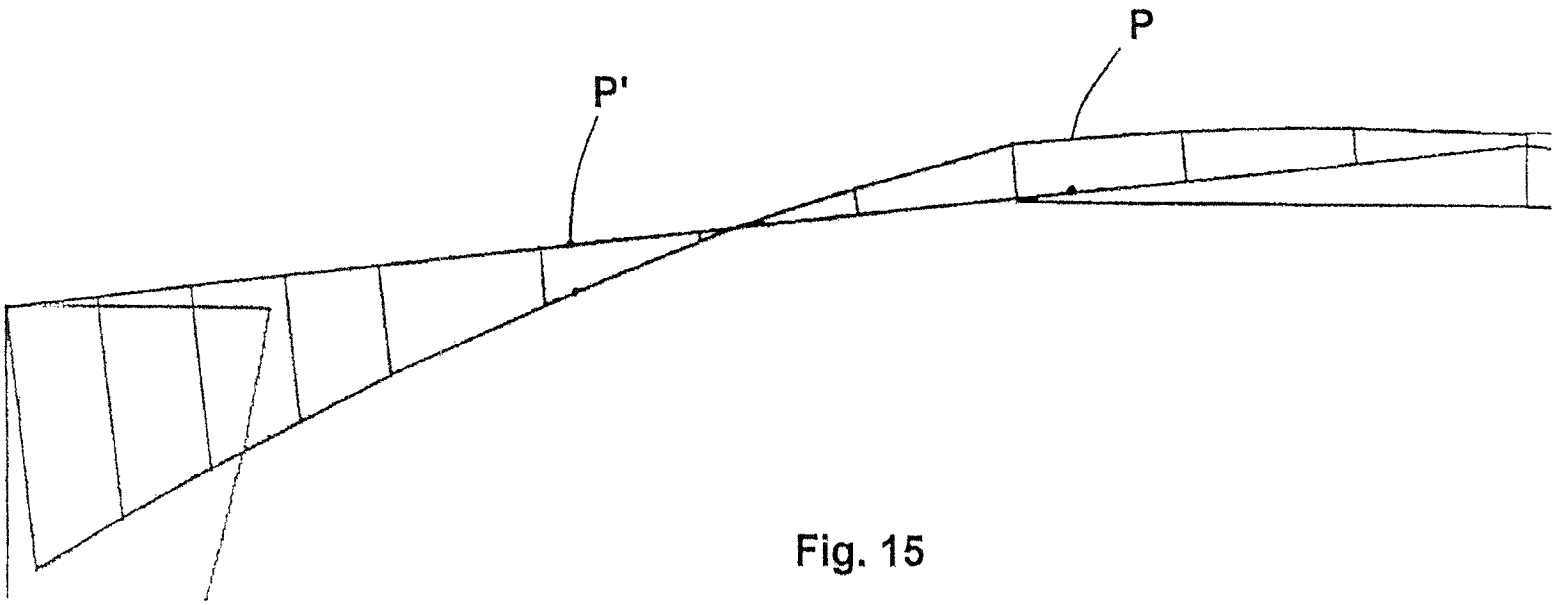
FIG. 15 is a diagram illustrating bending moment resistance requirements for a part of the portal frame of FIG. 12.
Figure 16:
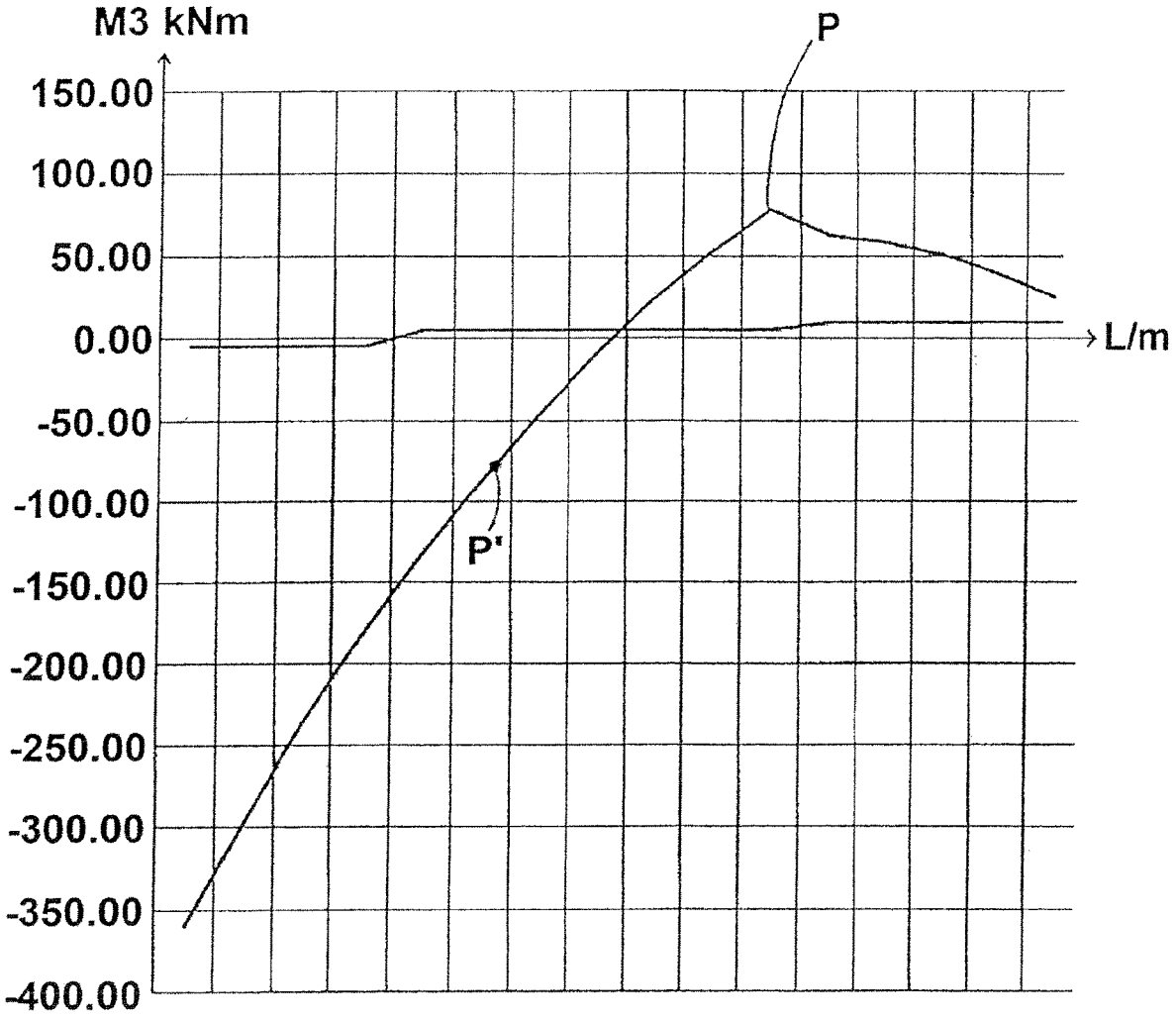
FIG. 16 is a graph of bending moment resistance requirement against length along a rafter of a portal frame.

The effect that this has will vary according to the circumstances. In the embodiment of FIG. 14 and Table 1 this means that the required capacity of the second member cannot be reduced by extending the first member beyond 3.5 metres (or 23.3% of the rafter length). However, as illustrated in FIG. 15, which is an enlargement of part of FIG. 12, the peak magnitude of the force that must be resisted by the rafter in the apex half of the rafter, indicated by point P may be proportionally smaller. In FIG. 15 the point in the column half of the rafter, indicated by point P', where the magnitude of the force that must be resisted by the rafter is equal to the peak magnitude of the force that must be resisted by the rafter in the apex half of the rafter (at point P) is at about 37% of the rafter length from the column. FIG. 16 is a standard format graph which illustrates length along a portal frame rafter from the column on the abscissa against bending moment that must be resisted on the ordinate axis and which shows an arrangement similar to the distribution of FIG. 15, in that the point in the column half of the rafter, indicated by point P', where the magnitude of the force that must be resisted by the rafter is equal to the peak magnitude of the force that must be resisted by the rafter in the apex half of the rafter (at point P) is at about 37% of the rafter length from the column.

Although the embodiment described above comprises both first and second members made from steel beams, it should be appreciated that the present disclosure is not limited to such materials or structures.

Alternative embodiments will be described with reference to FIGS. 17 to 20.

Figure 17:
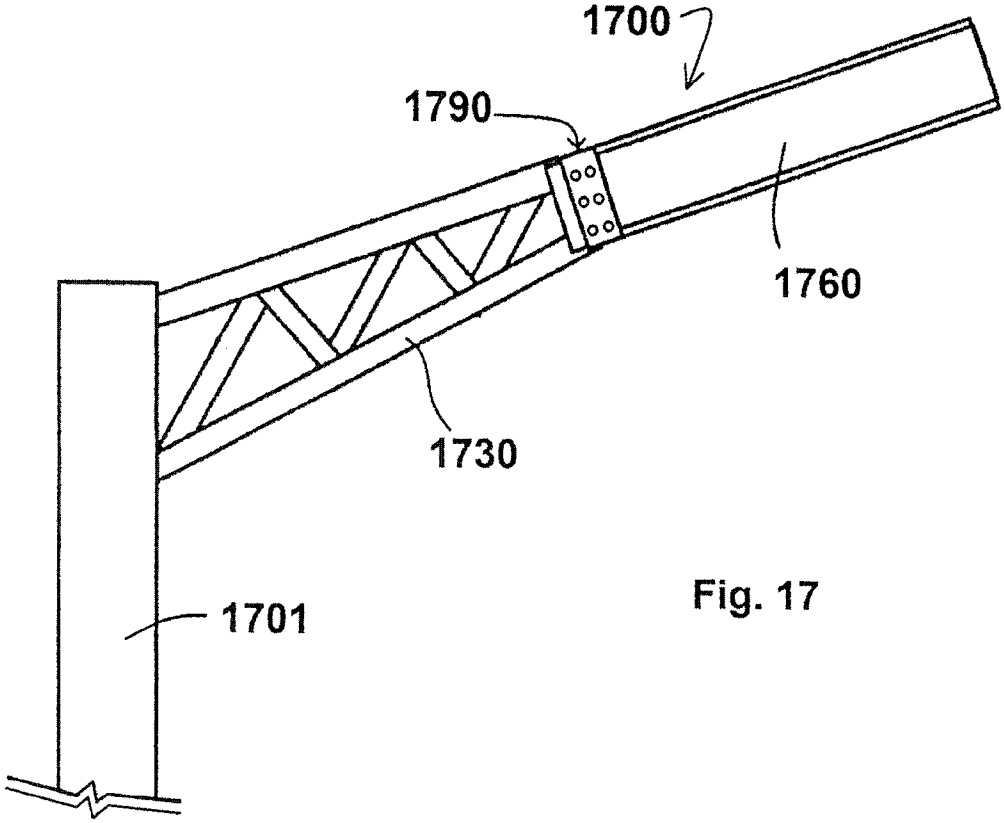
FIGS. 17 to 20 are side views which schematically illustrate alternative embodiments of composite structural members.

FIG. 17 shows part of an alternative embodiment of a portal frame 1700. A column 1701 of the portal frame 1700 is in the form of a universal beam made from hot roll mild steel. A first member 1730 of a composite structural member, connected to the column and suitable for resisting high bending moment or compression forces, is in the form of an open web of SHS or RHS steel sections. A second member 1760 of the composite structural member, suitable for resisting smaller magnitude bending moments, as required for this portion of the portal frame 1700 is in the form of a cold formed steel section beam.

The cold form steel section beam is less expensive per unit length than the open web of SHS or RHS steel sections, providing a cost benefit compared to use of an open web of SHS or RHS steel sections along the entire length of the rafter.

In a further alternative the second member 1760 may be made from timber. A timber member may provide a cost benefit compared to use of an open web of SHS or RHS steel sections along the entire length of the rafter.

In a further alternative the second member 1760 may be made from carbon fibre. Although carbon fibre may, at the time of writing, be considered too expensive for normal use in a portal frame, it is considered that if cost allows a carbon fibre second member may provide a light weight efficient alternative to use of an open web of SHS or RHS steel sections along the entire length of the rafter, and to timber or a cold formed steel section beam second members.

The connection between the first and second members 1730, 1760 may be any suitable connection that is capable of securing the members together in a manner that will adequately resist the expected load. The first and second members 1230, 1260 must be securely connected to each other by a connection, connection 1290 as illustrated, which has sufficient strength to withstand forces to which it will be subject in at least normal use. A suitable connection may include direct connection of parts of the first and second members to each other, for example by welding and/or suitable fasteners, and may alternatively or additionally include one or more connection plates which are connected to each of the first and second members 1230, 1260.

Figure 18:
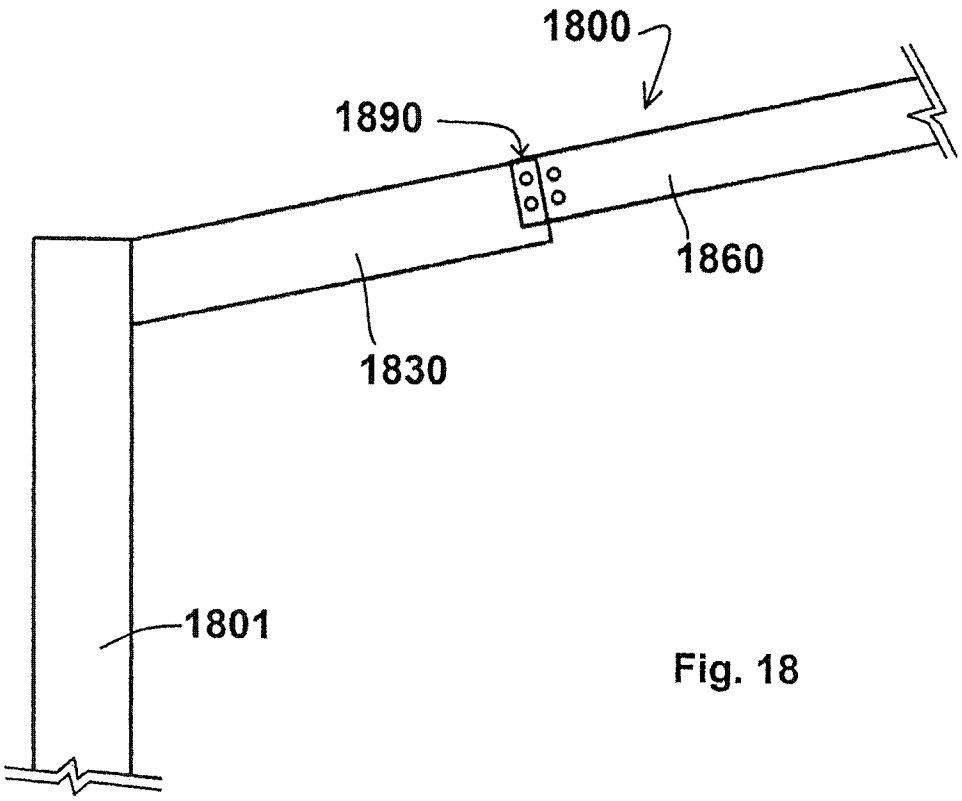

FIG. 18 shows part of a further alternative embodiment of a portal frame 1800. A column 1801 of the portal frame 1800 is made substantially from concrete. A first member 1830 of a composite structural member, connected to the column 1801 and suitable for resisting high bending moments, is in the form of a universal beam made from hot roll mild steel (and may be similar to the first member 30 of portal frame 1, described above). A second member 1860 of the composite structural member, suitable for resisting smaller magnitude bending moments, as required for this portion of the portal frame, is in the form of a timber beam. In a further alternative the second member 1860 may be made from cold form mild steel (and may be similar to the second member 60 of portal frame 1). As will be appreciated from the above, use of a suitable timber or cold form second member can provide a cost benefit compared to use of a universal beam made from hot roll mild steel along the entire length of the rafter. Further, timber may be locally and/or freely available where suitable steel members are less locally or freely available: in this case use of timber members may enable timely construction without delays associated with obtaining the type or quantities of steel member for which the timber member can act as a substitute.

In a further alternative the second member 1860 may be made from some other material suitable for resisting smaller magnitude bending moments, as required for this portion of the portal frame. Preferably the type of material and other characteristics are selected to provide some benefit over using a universal beam made from hot roll mild steel along the entire length of the rafter.

The first and second members 1830, 1860 must be securely connected to each other by a connection, connection 1890 as illustrated, which has sufficient strength to withstand forces to which it will be subject in at least normal use. The connection may be of any suitable type. A suitable connection may include direct connection of parts of the first and second members to each other, and may alternatively or additionally include one or more connection plates which are connected to each of the first and second members 1830, 1860.

Figure 19:
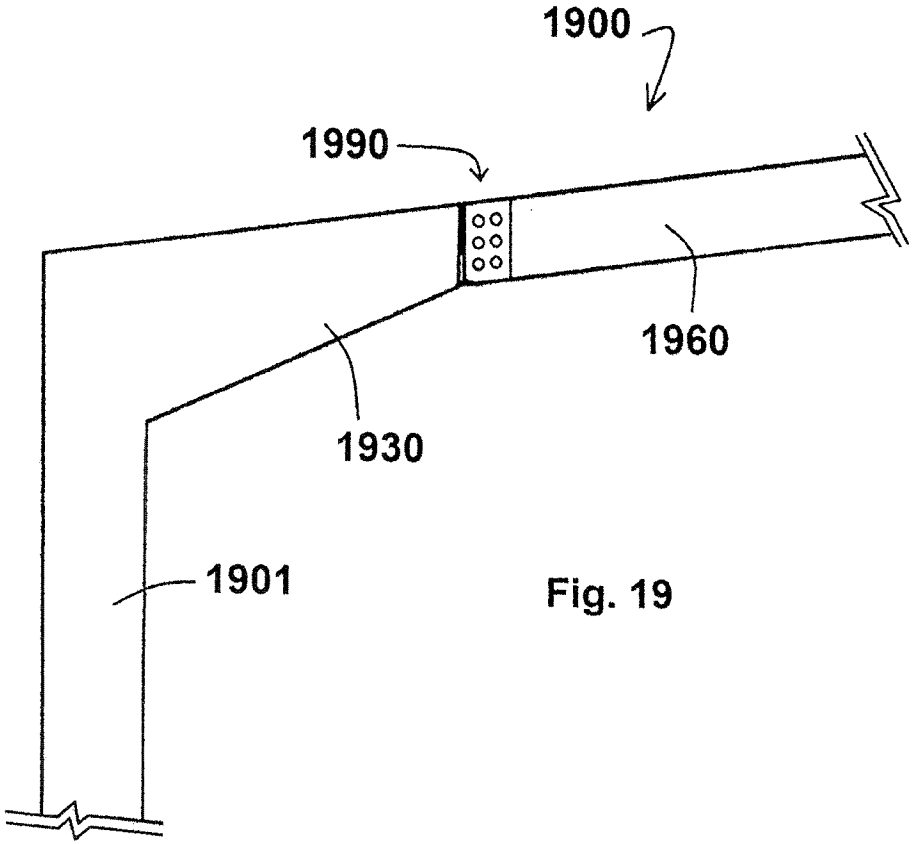

FIG. 19 shows part of a further alternative embodiment of portal frame 1900. A column 1901 of the portal frame 1900 is made substantially from concrete. A first member 1930 of a composite structural member, is also made of concrete and is formed integrally with the column 1901, preferably precast as a single unit. The concrete may be reinforced (for example with steel reo bars) if desired. It will be appreciated that concrete is extremely strong in compression, and it is therefore well suited for resisting compressive forces. A suitably dimensioned and steel reinforced concrete member may be suitable for resisting the high bending moments at the column end of a rafter of a portal frame.

A second member 1960 of the composite structural member, suitable for resisting smaller magnitude bending moments, as required for this portion of the portal frame, is in the form of a timber beam. In further alternatives the second member 1960 may be made from cold form steel section (and may be similar to the second member 60 of portal frame 1) or may be made of some other material.

An advantage of the portal frame 1900 is that it allows the column 1901 and part of the length of the rafter (first member 1930) to be precast as a single reinforced concrete unit which may be economically desirable and can allow good quality control at the site of manufacture. Using a different material, such as timber or cold form steel section, for the part of the rafter of the portal frame which is closer to the apex (not shown) rather than forming the entire rafter part from precast reinforces concrete avoids attempted provision of a long near horizontal concrete member. Reinforced concrete would likely be unsuitable for such use, or if rendered suitable by adequate reinforcement would be prohibitively expensive.

The first and second members 1930, 1960 must be securely connected to each other by a connection, connection 1990 as illustrated, which has sufficient strength to withstand forces to which it will be subject in at least normal use. The connection may be of any suitable type. A suitable connection may include one or more connection plates, or fishplates, cast into the concrete forming the first member 1930 during manufacture thereof.

Figure 20:
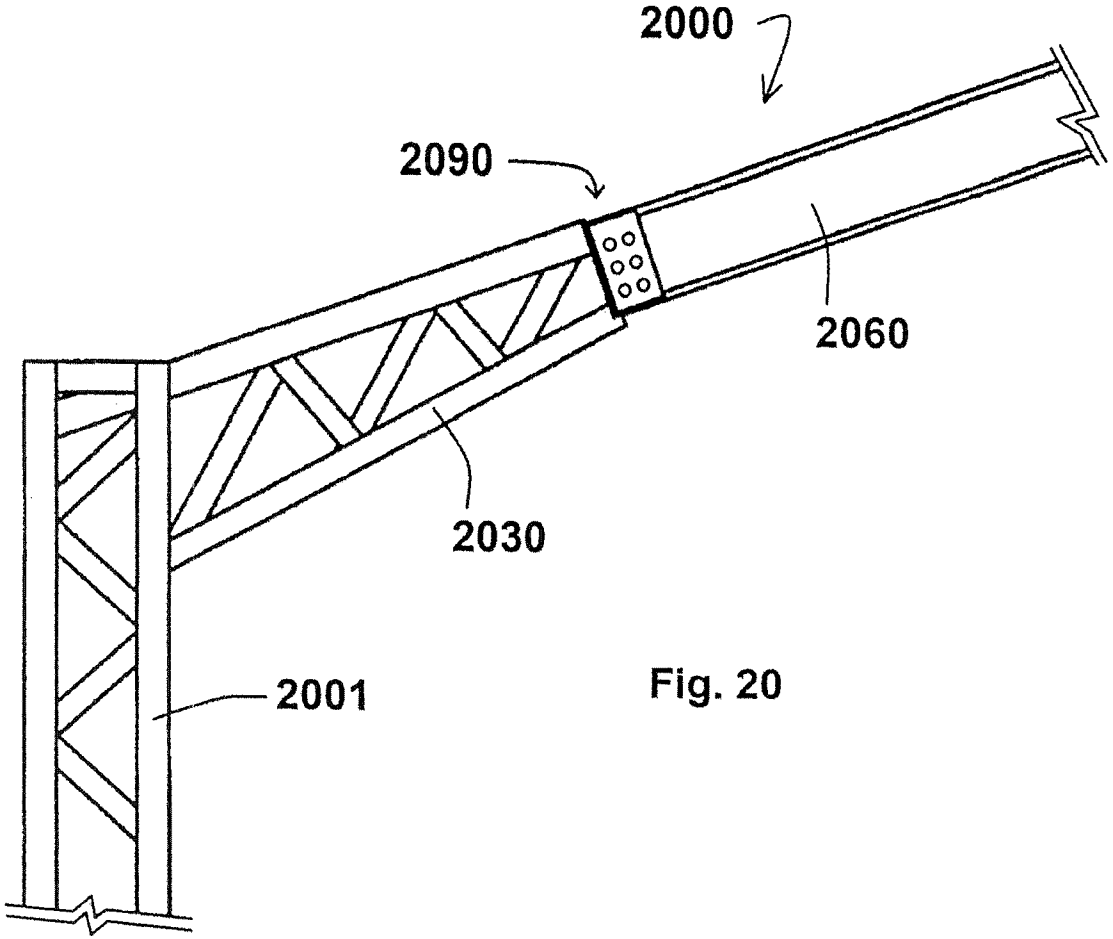

FIG. 20 shows part of a further alternative embodiment of a portal frame 2000. A column 2001 of the portal frame 2000 is in the form of an open web of SHS or RHS steel sections suitable for resisting high bending moments. A first member 2030 of a composite structural member is also in the form of an open web of SHS or RHS steel sections. A second member 2060 of the composite structural member, suitable for resisting smaller magnitude bending moments, as required for this portion of the portal frame, is in the form of a timber beam. In further alternatives the second member 2060 may be made from cold form mild steel (and may be similar to the second member 60 of portal frame 1) or may be made of some other material suitable for resisting smaller magnitude bending moments, as required for this portion of the portal frame. As with the other embodiments, a suitable connection, connection 2090 as illustrated, must be provided between the first and second members 2030, 2060.

In all embodiments the connection 90, 1790, 1890, 1990, 2090, must take into consideration transmission of forces between the members so that the connection does not cause the members to be subject to forces beyond their capacities. This may be a particular consideration where concrete or an open web structure is used for the first member. However, both concrete and open web structures have been widely used in constructions and the like in which substantial forces are accommodated, and the provision of suitable connections is considered to be available to, or within the capability of, the skilled addressee.

It will be appreciated that the above described embodiment provides a composite structural member for a building which can enhance performance and economy by providing different materials and structures at different points along the length of the structural member, each appropriate for the forces to be resisted at those points. More specifically, in described embodiments comprising a rafter for a portal frame, a material and structure suitable for resisting high bending moments is used close to the column, and a material and structure suitable for resisting smaller magnitude bending moments, but incapable of resisting the high moment or compressive forces applied close to the column, is used closer to the apex allowing significant cost savings.

More generally, the use of a composite structural member for a building in accordance with the present disclosure allows use of respective different materials, at respective different parts along the length of the composite structural member, which can efficiently meet the design requirements of the structural member.

It should particularly be appreciated that the use of different materials (including different grades and/or types of steel) at respective different parts along the length of the composite structural member is significantly different to merely providing differently sized, shaped or dimensioned members formed of the same material. The use of different materials allows much greater design choice. Further the use of different materials allows selection of components which are particularly effective for meeting the load resistance requirements at different parts along the length of the structural member. For example, it may be found that a part of a rafter of a portal frame in the half of the rafter closer to the apex requires a particularly high resistance to tensile forces, compared to the required resistance to bending moments at the same part. With reference to the described embodiment, in which the first member 30 comprises a hot-roll UB and the second member 60 comprises a cold formed steel section, a suitable second (cold formed) member selected such that its capacity to resist bending moments is substantially fully utilised will be able to meet the requirement for resisting tensile forces. In contrast, using, as a second member, a hot roll, mild steel UB (which is a member of the same material as the first member) which is merely sized differently to the first member to reduce weight and cost, selected such that its capacity to resist bending moments is substantially fully utilised, will likely not be capable of meeting the requirement for resisting tensile forces.

It should be appreciated that although the embodiments described above relate to a composite structural member in the form of a composite rafter, the present disclosure is also applicable to other types of structural member. Further, although the forces referred to in relation to the embodiments described above are bending moments, the selection of first and second members may be based upon other types of force, for example shear action effects, torsion, buckling and axial compressive action effects.

For example, an embodiment of a composite structural member for a building may be in the form of a vertical support, such as, but not limited to, a column for a portal frame. In such an embodiment a lower portion of a composite structural member may be required to be capable of resisting a high magnitude compressive force, and a higher portion of the composite structural member may be required to resist only a smaller magnitude compressive force. This can occur, for example, when a portal frame of a building is required to support a mezzanine floor, the lower portion of the portal frame column being required to resist compressive forces resulting from the weight of the building roof and the mezzanine floor, and the higher portion of the portal frame column, at least part of which is located above the level of the mezzanine floor, being required to resist compressive forces resulting from the weight of the building roof but not compressive forces resulting from the weight of the mezzanine floor. In such a case the lower portion may comprise an open lattice formed of metal members such as SHS or RHS steel members, and the higher portion of the portal frame column may comprise a UB.

Modifications and improvements may be incorporated without departing from the scope of the claims appended hereto.

The invention claimed is:

1. A method for use in designing a composite rafter for a building structure, wherein the composite rafter is required to have a first member with a first end region and a second end region, a second member with a first end region and a second end region, the first end region of the first member connected or connectable to a support portion of the building, the second end region of the first member connected or connectable to the first end region of the second member, and the design of the rafter is required to be such that, in use, the second end region of the second member is located higher than the first end region of the first member, the method comprising:

assessing bending moments which the rafter is required to be capable of resisting at various points or regions along the length of the rafter;

determining at least one point or region along the length of the rafter which is to be provided where the bending moment which the rafter is required to resist is maximum;

identifying a first type of structural component with a first bending moment bearing capacity which is capable of resisting said maximum bending moment, and selecting a structural component of the first type to use as the first member of the rafter;

determining at least one point or region along the length of the rafter which is to be provided where the bending moment which the rafter is required to resist is substantially smaller than said maximum bending moment;

identifying a second type of structural component which is different from the first type of structural component and wherein the second type of structural component has a second bending moment bearing capacity which is capable of resisting said smaller bending moment but not necessarily capable of resisting said maximum bending moment, and selecting a structural component of the second type to use as the second member of the rafter; and determining a position, along the length of the rafter which is to be provided, at which to provide a join or transition between the first member and the second member, wherein the position of the join or transition is such that bending moments in portions of the rafter formed by the second member do not exceed the second bending moment bearing capacity.

2. The method as claimed in claim 1, wherein the position of the join or transition is such that bending moments in portions of the rafter formed by the second member do not exceed 90% of the second bending moment bearing capacity.

3. The method as claimed in claim 1, wherein the position of the join or transition is such that bending moments in portions of the rafter formed by the second member do not exceed 80% of the second bending moment bearing capacity.

4. The method as claimed in claim 1, wherein the position of the join or transition is such that bending moments in portions of the rafter formed by the second member do not exceed 70% of the second bending moment bearing capacity.

5. The method as claimed in claim 1, wherein the position of the join or transition is a position at which the length of the first member is no more than 150% greater than the minimum length that the first member can have, with the second type of structural component used as the second member of the rafter, without the bending moment in portions of the rafter formed by the second member exceeding the second bending moment bearing capacity.

6. The method as claimed in claim 1, wherein the position of the join or transition is a position at which the length of the first member is no more than 100% greater than the minimum length that the first member can have, with the second type of structural component used as the second member of the rafter, without the bending moment in portions of the rafter formed by the second member exceeding the second bending moment bearing capacity.

7. The method as claimed in claim 1, wherein the position of the join or transition is a position at which the length of the first member is no more than 60% greater than the minimum length that the first member can have, with the second type of structural component used as the second member of the rafter, without the bending moment in portions of the rafter formed by the second member exceeding the second bending moment bearing capacity.

8. The method as claimed in claim 1, wherein the position of the join or transition is a position at which the length of the first member is substantially the minimum length that the first member can have, with the second type of structural component used as the second member of the rafter, without the bending moment in portions of the rafter formed by the second member exceeding the second bending moment bearing capacity.

9. The method as claimed in claim 1, wherein the first type of structural component and the second type of structural component are different by virtue of being made of different types of material and/or by virtue of being of different constructions.

10. The method as claimed in claim 9, wherein the first type of structural component and the second type of structural component are made of different types or grades of steel.

11. The method as claimed in claim 9, wherein the first type of structural component comprises a hot rolled steel member.

12. The method as claimed in claim 11, wherein the first type of structural component comprises a beam fabricated from hot rolled steel with an I-shaped or H-shaped cross-section.

13. The method as claimed in claim 9, wherein the second type of structural component comprises a cold formed steel member or a timber (wooden) member or a carbon fibre member.

14. The method as claimed in claim 13, wherein the second type of structural component comprises a beam fabricated from two metal sections connected along their length.

15. The method as claimed in claim 14, wherein the second type of structural component comprises two cold formed steel C-channel section beams attached to one another back to back along their length.

16. The method as claimed in claim 1, wherein the second member is at least 1.5 times the length of the first member.

17. The method as claimed in claim 1, wherein the second member is at least twice the length of the first member.

18. The method as claimed in claim 1, wherein the second member is at least four times the length of the first member.

19. The method as claimed in claim 1, wherein the position of the join or transition is determined such that the cost of the rafter, and/or the cost of multiple of the rafters produced at or around the same time, is largely minimized based on per unit length costs and/or other costs associated with the types of structural components used as the first member and the second member and/or the number of rafters to be produced.

20. The method as claimed in claim 1, wherein the expected loading on the rafter when the rafter is in use is such that the magnitude of the bending moment in the rafter changes along the length of the rafter and the direction (sign) of the bending moment in the rafter changes at a point of contraflexure, and if the point of contraflexure is located between the first and second end regions of the second member, the distance from the first end of the second member to the point of contraflexure is such that, based on the expected loading on the rafter, the magnitude of the bending moment does not exceed the second bending moment bearing capacity anywhere in the second member.

* * * * *